US010458207B1

(12) United States Patent
Matringe et al.

(10) Patent No.: US 10,458,207 B1
(45) Date of Patent: Oct. 29, 2019

(54) REDUCED-PHYSICS, DATA-DRIVEN SECONDARY RECOVERY OPTIMIZATION

(71) Applicant: QRI GROUP, LLC, Houston, TX (US)

(72) Inventors: Sébastien Matringe, Houston, TX (US); Tailai Wen, Houston, TX (US); Xiang Zhai, Houston, TX (US)

(73) Assignee: QRI GROUP, LLC, Houston, TX (US)

( * ) Notice: Subject to any disclaimer, the term of this patent is extended or adjusted under 35 U.S.C. 154(b) by 207 days.

(21) Appl. No.: 15/618,890

(22) Filed: Jun. 9, 2017

Related U.S. Application Data

(60) Provisional application No. 62/347,970, filed on Jun. 9, 2016.

(51) Int. Cl.

| | |
|---|---|
| ***E21B 41/00*** | (2006.01) |
| ***E21B 47/06*** | (2012.01) |
| ***E21B 47/10*** | (2012.01) |
| ***E21B 43/20*** | (2006.01) |
| ***E21B 43/16*** | (2006.01) |
| *E21B 49/00* | (2006.01) |
| *E21B 43/40* | (2006.01) |

(52) U.S. Cl.
CPC ..... *E21B 41/0092* (2013.01); *E21B 43/168* (2013.01); *E21B 43/20* (2013.01); *E21B 47/06* (2013.01); *E21B 47/1015* (2013.01); *E21B 43/40* (2013.01); *E21B 47/065* (2013.01); *E21B 49/00* (2013.01)

(58) Field of Classification Search
CPC .. E21B 41/0092; E21B 43/20; E21B 47/1015; E21B 47/06; E21B 43/168; E21B 43/40; E21B 49/00; E21B 47/065
See application file for complete search history.

(56) References Cited

U.S. PATENT DOCUMENTS

| | | | |
|---|---|---|---|
| 3,035,440 | A | 5/1962 | Reed |
| 5,984,010 | A | 11/1999 | Elias et al. |
| 6,101,447 | A | 8/2000 | Poe |
| 7,079,952 | B2 | 7/2006 | Thomas et al. |
| 7,289,942 | B2 | 10/2007 | Yang et al. |
| 7,445,041 | B2 | 11/2008 | O'Brien |

(Continued)

OTHER PUBLICATIONS

U.S. Appl. No. 14/836,564, filed Aug. 26, 2015, Mondal et al.

(Continued)

*Primary Examiner* — Brad Harcourt
(74) *Attorney, Agent, or Firm* — Workman Nydegger

(57) ABSTRACT

Embodiments are directed to modeling physical material flow relationships between injector wells and producer wells in a reservoir and to quantifying a level of uncertainty in a connection-based model. In one scenario, a computer system calculates pressure distribution within the reservoir using sensor data. Next, the computer system applies the calculated pressure distribution as an input to a tracer algorithm for an injector well and for a producer well to identify tracer flow values for materials flowing from the injector well to the producer well. The computer system further combines the identified tracer flow values to generate well allocation factors representing relationships in material flow. The computer system then determines the efficiency of each inter-well connection using a fractional flow model that incorporates the determined material flow strength measurement, and provides the inter-well connection efficiencies to a controller for controlling material flow through the injector and/or the producer well.

18 Claims, 11 Drawing Sheets

(56) References Cited

U.S. PATENT DOCUMENTS

| | | | |
|---|---|---|---|
| 7,556,099 | B2 | 7/2009 | Arthur et al. |
| 7,798,219 | B1 | 9/2010 | Harnoy |
| 7,890,264 | B2 | 2/2011 | Elphic |
| 7,963,327 | B1 | 6/2011 | Saleri et al. |
| 8,145,427 | B1 | 3/2012 | Saleri et al. |
| 8,145,428 | B1 | 3/2012 | Saleri et al. |
| 8,195,401 | B2 | 6/2012 | Ella et al. |
| 8,209,202 | B2 | 6/2012 | Narayanan et al. |
| 8,880,422 | B1 | 11/2014 | Lehmann et al. |
| 9,710,766 | B2 | 7/2017 | Saleri et al. |
| 9,767,421 | B2 | 9/2017 | Saleri et al. |
| 2001/0015133 | A1 | 8/2001 | Sakai et al. |
| 2001/0037983 | A1 | 11/2001 | Takahashi et al. |
| 2002/0013687 | A1 | 1/2002 | Ortoleva |
| 2002/0120429 | A1 | 8/2002 | Ortoleva |
| 2003/0225606 | A1 | 12/2003 | Raghuraman et al. |
| 2004/0015376 | A1 | 1/2004 | Zhu et al. |
| 2004/0158406 | A1 | 8/2004 | Harrison |
| 2004/0220846 | A1 | 11/2004 | Cullick |
| 2005/0038603 | A1 | 2/2005 | Thomas et al. |
| 2005/0149307 | A1 | 7/2005 | Gurpiner et al. |
| 2005/0209912 | A1 | 9/2005 | Venningen et al. |
| 2006/0224369 | A1 | 10/2006 | Yang et al. |
| 2006/0289157 | A1 | 12/2006 | Rao |
| 2007/0016389 | A1 | 1/2007 | Ozgen |
| 2007/0028417 | A1 | 2/2007 | Crichlow |
| 2007/0143025 | A1 | 6/2007 | Valdez et al. |
| 2007/0179768 | A1 | 8/2007 | Cullick et al. |
| 2007/0284107 | A1 | 12/2007 | Crichlow |
| 2008/0052097 | A1 | 2/2008 | Bouzas et al. |
| 2008/0091283 | A1 | 4/2008 | Balci et al. |
| 2008/0252898 | A1 | 10/2008 | Pfaff |
| 2008/0262898 | A1 | 10/2008 | Tonchev et al. |
| 2009/0005630 | A1 | 1/2009 | Yokoyama et al. |
| 2009/0037115 | A1 | 2/2009 | Magill et al. |
| 2009/0133871 | A1 | 5/2009 | Skinner et al. |
| 2009/0313772 | A1 | 12/2009 | Talley |
| 2010/0042458 | A1 | 2/2010 | Rashid et al. |
| 2010/0057418 | A1 | 3/2010 | Li et al. |
| 2010/0082142 | A1 | 4/2010 | Usadi et al. |
| 2010/0204972 | A1 | 8/2010 | Hsu et al. |
| 2010/0300682 | A1 | 12/2010 | Thakur et al. |
| 2011/0014088 | A1 | 1/2011 | Zubrin et al. |
| 2011/0054869 | A1 | 3/2011 | Li |
| 2011/0067443 | A1 | 3/2011 | Martinez et al. |
| 2011/0168391 | A1 | 7/2011 | Saleri et al. |
| 2011/0290479 | A1 | 12/2011 | Izgec |
| 2012/0101759 | A1 | 4/2012 | Rai et al. |
| 2012/0232865 | A1 | 9/2012 | Maucec et al. |
| 2012/0292055 | A1 | 11/2012 | Swist |
| 2013/0048279 | A1 | 2/2013 | Appel et al. |
| 2013/0110474 | A1 | 5/2013 | Saleri |
| 2013/0110524 | A1 | 5/2013 | Saleri et al. |
| 2013/0151159 | A1 | 6/2013 | Pomerantz et al. |
| 2013/0161502 | A1 | 6/2013 | Pomerantz et al. |
| 2013/0218538 | A1 | 8/2013 | Fuecker et al. |
| 2013/0338987 | A1 | 12/2013 | Cheng et al. |
| 2015/0337631 | A1 | 11/2015 | Matringe et al. |
| 2015/0346010 | A1 | 12/2015 | Matringe et al. |

OTHER PUBLICATIONS

U.S. Appl. No. 15/299,298, filed Oct. 21, 2016, Saleri et al.
U.S. Appl. No. 15/408,397, filed Jan. 17, 2016, Saleri et al.
U.S. Appl. No. 15/618,399, filed Jun. 9, 2017, Saleri et al.
Batavia, "Front-End Loading for Life Cycle Success", Offshore Technology Conference Paper No. OTC-12980; Published Apr. 2001.
BDM-Oklahoma, Inc., "Feasability Study of Heavy Oil Recovery in the United States", U.S. Department of Energy, Document No. NIPER/BDM-0225; Published Mar. 1995.
Burns et al., "Gas Field Development: Automatic Selection of Locations for New Producing Wells", Society of Petroleum Engineers, Document No. SPE-2429; Published 1969.
Cordazzo et al., "Interblock Transmissibility Calculation Analysis for Petroleum Reservoir Simulation", Federal University of Santa Catarina, Nov. 2002, pp. 1-18.
Fiksel et al., "Measuring Progress Towards Sustainability Principles, Process, and Best Practices", 1999 Greening of Industry Network Conference Best Practice Proceedings.
Freudenrich, Ph.D., Craig, and Jonathan Strickland, "How Oil Drilling Works" Apr. 12, 2001. HowStuffWorks.com retrieved from WayBack Machine, http://web.archive.org/web/20060418040616/http://science.howstuffworks.com/oil-drilling.htm/printable.
Graf et al., "Candidate Selection Using Stochastic Reasoning Driven by Surrogate Reservoir Models"; Society of Petroleum Engineers, Document No. SPE-136373; SPE Reservoir Evaluation and Engineering; Published Aug. 2011; p. 433-442.
Ham, Jerry, Ranking of Texas Reservoirs for Application of Carbon Dioxide Miscible Displacement, Apr. 1996.
Helman, "The Octopus", Forbes Energy & Genius, pp. 454-51, Nov. 24, 2008.
Investopedia.com, "What are leading, lagging, and coincident indicators? What are they for?", http://www.investopedia.com/ask/answers/177.asp, retrieved on Feb. 27, 2012 .
Investorwords.com, "lagging indicator", "leading indicator", http://www.investorwords.com/2713/lagging_indicator.html, http://www.investorwords.com/2741/leading_indicator.html.
Izgec et al, "Quantifying Reservoir Connectivity, In-Place Volumes, and Drainage-Area Pressures during Primary Depletion"; Elsevier, 2009; Journal of Petroleum Science and Engineering, vol. 69; p. 7-17.
Jolley et al., Reservoir Compartmentalization: An Introduction; Reservoir Compartmentalization; The Geological Society of London, 2010; Special Publications vol. 347; pp. 1-8.
Kabir et al., "Diagnosis and Reservoir Compartmentalization from Measured Pressure/Rate Data during Primary Depletion"; Elsevier, 2009; Journal of Petroleum Science and Engineering, vol. 69, pp. 271-282.
McElroy, "Transient Pressure Analysis in Strip Reservoirs with Linear Skin Discontinuities", Stanford University, 1986, p. 1-58.
"The Report of the BP U.S. Refineries Independent Safety Review Panel", Jan. 2007.
Rivas et al., "Ranking Reservoirs for Carbon Dioxide Flooding Processes", 1994.
Saleri et al., "Data and Data Hierarchy", SPE 21369, pp. 1286-1293, Dec. 1992.
Saleri, "Dawn in the Desert: Saudi High Tech Paying Off at Ghawar", Energy Tribune, pp. 15-17, Sep. 2007.
Saleri et al., "Engineering Control in Reservoir Simulation: Parts I and II", SPE 18305, 1988.
Saleri et al., "The Expanding Role of the Drill Bit in Shaping the Subsurface", JPT, pp. 53-58, Dec. 2003.
Saleri, "Haradh III: A Milestone for Smart Fields", JPT, Nov. 2006.
Saleri, "'Learning' Reservoirs: Adapting to Disruptive Technologies", JPT, pp. 57-60, Mar. 2002.
Saleri, "The Next Trillion: Anticipating and Enabling Game-Changing Recoveries", JPT, Apr. 2006.
Saleri, "Reservoir Management Tenets: Why They Matter to Sustainable Supplies", JPT, pp. 28-30, Jan. 2005.
Saleri, "Reservoir Performance Forecasting: Acceleration by Parallel Planning", JPT, pp. 652-657, Jul. 1993.
Saleri et al., "Shaybah-220: A Maximum-Reservoir-Contact (MRC) Well and Its Implications for Developing Tight-Facies Reservoirs", SPE Reservoir Evaluation & and Its Implications.
Saleri, "Tenets and Diagnostics in Modern Reservoir Management", 8th International Forum on Reservoir Simulation, Jun. 2005, Stressa, Italy.
Sayarpour et al., "The use of capacitance-resistance models for rapid estimation of waterflood performance and optimization", Journal of Petroleum Science and Engineering, 69 (2009, 227-238).
Schlumberger.com retrieved from WayBack Machine, http://web.archive.org/web/20071230014516/http://www.slb.com/.
Slide from 2003 Presentation by Joe Ault.
Smalley et al., "Reservoir Compartmentalization Assessed with Fluid Compositional Data", Society of Petroleum Engineers, Aug. 1994; SPE Reservoir Engineering, vol. 9 Is. 3; p. 175-180.

(56) References Cited

OTHER PUBLICATIONS

Society of Petroleum Engineers, "Petroleum Resources Management System"; SPE/World Petroleum Council; Published Apr. 2007.
Society of Petroleum Engineers, "Guidelines for the Evaluation of Petroleum Reserves and Resources"; SPE in associate with World Petroleum Congresses and American Association of Petroleum Geologists, 2001; pp. 1-139.
Yin "Geomechanics-Reservoir Modeling by Displacement Discontinuity-Finite Element Method" University of Waterloo, 2008, p. 1-141.
U.S. Appl. No. 12/392,891, filed Feb. 25, 2009, Office Action dated Dec. 8, 2010.
U.S. Appl. No. 12/392,891, filed Feb. 25, 2009, Notice of Allowance dated Mar. 24, 2011.
U.S. Appl. No. 12/606,027, filed Oct. 26, 2009, Office Action dated Aug. 10, 2011.
U.S. Appl. No. 12/915,278, filed Oct. 29, 2010, Office Action dated Nov. 7, 2011.
U.S. Appl. No. 12/567,361, filed Sep. 25, 2009 Office Action dated Nov. 30, 2011.
U.S. Appl. No. 12/567,404, filed Sep. 29, 2009, Office Action dated Dec. 8, 2011.
U.S. Appl. No. 12/606,027, filed Oct. 26, 2009, Final Office Action dated Jan. 19, 2012.
U.S. Appl. No. 12/567,361, filed Sep. 25, 2009, Notice of Allowance dated Feb. 2, 2012.
U.S. Appl. No. 12/567,404, filed Sep. 25, 2009, Notice of Allowance dated Feb. 7, 2012.
U.S. Appl. No. 12/915,278, filed Oct. 29, 2010, Final Office Action dated Mar. 1, 2012.
U.S. Appl. No. 13/282,297, filed Oct. 26, 2011, Office Action dated Apr. 1, 2013.
U.S. Appl. No. 13/282,297, filed Oct. 26, 2011, Final Office Action dated Sep. 11, 2013.
U.S. Appl. No. 13/282,297, filed Oct. 26, 2011, Advisory Action dated Nov. 18, 2013.
U.S. Appl. No. 13/282,282, filed Oct. 26, 2011, Office Action dated Mar. 27, 2014.
U.S. Appl. No. 13/282,315, filed Oct. 26, 2011, Office Action dated Aug. 18, 2014.
U.S. Appl. No. 13/282,272, filed Oct. 26, 2011, Office Action dated Nov. 7, 2014.
U.S. Appl. No. 13/282,282, filed Oct. 26, 2011, Final Office Action dated Dec. 26, 2014.
U.S. Appl. No. 13/282,315, filed Oct. 26, 2011, Office Action dated Feb. 18, 2015.
U.S. Appl. No. 13/282,297, filed Oct. 26, 2011, Office Action dated Mar. 16, 2015.
U.S. Appl. No. 13/282,282, filed Oct. 26, 2011, Office Action dated May 11, 2015.
U.S. Appl. No. 13/282,315, filed Oct. 26, 2011, Final Office Action dated Jun. 25, 2015.
U.S. Appl. No. 13/282,282, filed Oct. 26, 2011 Office Action dated Nov. 20, 2015.
U.S. Appl. No. 13/282,282, filed Oct. 26, 2011, Notice of References cited Nov. 30, 2015.
U.S. Appl. No. 13/282,272, filed Oct. 26, 2011, Final Office Action dated Dec. 9, 2015.
U.S. Appl. No. 13/282,297, filed Oct. 26, 2011, Final Office Action dated Dec. 30, 2015.
U.S. Appl. No. 13/282,315, filed Oct. 26, 2011, Office Action dated Mar. 9, 2016.
U.S. Appl. No. 13/282,272, filed Oct. 26, 2011, Office Action dated May 19, 2016.
U.S. Appl. No. 13/282,272, filed Oct. 26, 2011, Final Office Action dated Aug. 23, 2016.
U.S. Appl. No. 13/282,315, filed Oct. 26, 2011, Final Office Action dated Sep. 14, 2016.
U.S. Appl. No. 13/282,297, filed Oct. 26, 2011, Office Action dated Oct. 12, 2016.
U.S. Appl. No. 13/282,282, filed Oct. 26, 2011, Final Office Action dated Nov. 14, 2016.
U.S. Appl. No. 13/282,282, filed Oct. 26, 2011, Notice of Allowance dated Mar. 16, 2017.
U.S. Appl. No. 14/604,367, filed Jan. 23, 2015, Office Action dated Jun. 16, 2017.
U.S. Appl. No. 14/604,330, filed Jan. 23, 2015, Office Action dated Jun. 30, 2017.
U.S. Appl. No. 15/299,828, filed Oct. 21, 2016, Office Action dated Aug. 17, 2017.
U.S. Appl. No. 14/604,367, filed Jan. 23, 2015, Final Office Action dated Sep. 21, 2017.

Variation of Well Allocation Factor Over Time For The X1-9-1H Producer

Efficiency of the Connection Between Producer X1-9-1H and Injector X1-8-1H Over Time Visualization of the Inter-Well And Well-Aquifier Connections for a Group of Wells Visualization of the Inter-Wall and Well-Aquifier Connections for a Specific Well of Interest Visualization of the Uncertainty of Inter-Wall and Well-Aquifer Connections Efficiency

REDUCED-PHYSICS, DATA-DRIVEN SECONDARY RECOVERY OPTIMIZATION

CROSS-REFERENCE TO RELATED APPLICATIONS

This application claims priority to and the benefit of U.S. Provisional Patent Application Ser. No. 62/347,970, entitled "Reduced-Physics, Data-Driven Secondary Recovery Optimization," filed on Jun. 9, 2016, which application is incorporated by reference herein in its entirety.

BACKGROUND

Hydrocarbon reservoirs are exploited by drilling wells in a hydrocarbon bearing geologic formation. In primary recovery projects, producing wells (or "producers" herein) are drilled and the pressure naturally present in the reservoir drives the reservoir fluids (usually hydrocarbons and water) through the well to the surface. In secondary recovery projects, injecting wells (or "injectors" herein) are used to inject fluids into the reservoir in order to replace the fluids that have been produced, and maintain the reservoir pressure. These injectors can either be drilled anew or can be created through a conversion of an existing producer. Usually, an inexpensive fluid such as water or gas is injected in the formation for voidage replacement.

The producing wells deliver different fluids to the surface that are separated according to their phase: oil, water or gas. The fluids that can be commercialized are sold (usually oil and gas) and the fluids that are by-products of the production are disposed of (usually water and sometimes gas). The injection fluids can come from various sources. In some cases, they are unwanted production fluids, and in other cases, they are brought in from other sources such as nearby fields or pipelines, dedicated source reservoirs, etc. The injection fluids usually represent a cost for the company operating the field as they have to be separated from produced fluids or transported from other locations. The injection fluids are also often treated prior to injection to avoid creating formation damages.

Successful exploitation of an existing secondary recovery project involves maximizing the production of commercial fluids and minimizing the production of unwanted fluids as well as minimizing the injection of costly fluids. This can be achieved through continuous optimization of the production and injection strategy: controlling the flow rates and pressures of the producing and injecting wells in order to optimize the production and injection behavior.

This optimization of wells is usually performed by looking at complex reservoir or surface models, but these models are often too simplistic to truly provide insightful guidance, or are too complex to be used at the operational pace of production. In some cases, reservoir simulators may be used to forecast the production of wells in order to evaluate the possible outcomes of operational changes.

Reservoir simulators can be created in a variety of ways, but for the purpose of production optimization, the simulator should be both fast and accurate. The accuracy of the simulator is defined as the predictive power of the simulator: its ability to predict future well performance accurately and with a high level of confidence. The simulator's accuracy helps guarantee the economic success of the operational changes implemented. The speed of the simulator is defined as the time it takes to create or update a model and to perform a simulation. A fast simulator would update the model with new data in order to support daily operational decisions in a timely fashion.

BRIEF SUMMARY

Embodiments described herein are directed to measuring, modeling, and controlling physical material flow relationships between injector wells and producer wells in a reservoir and to quantifying a level of uncertainty in a connection-based model. In one embodiment, a computer system receives sensor data from hardware-based sensors distributed in various locations within a reservoir. The sensor data indicates a material flow rate currently present at each sensor location. The computer system also calculates pressure distribution within the reservoir using a stationary pressure algorithm to identify variations of pressure at the various locations within the reservoir using the received sensor data. Next, the computer system applies the calculated pressure distribution as an input to a tracer algorithm for an injector well and for a producer well to identify tracer flow values for materials flowing from a seed point in the injector well to the producer well. The tracer values provide an indication of material flow volume attributable to the seed point.

The computer system further combines the identified tracer flow values from the tracer algorithm to generate well allocation factors representing relationships in material flow through inter-well connections between the injector well and the producer well. These well allocation factors provide a measurement of material flow strength between wells. The computer system then determines a current material flow efficiency level of each inter-well connection using a fractional flow model that incorporates as input the determined material flow strength measurement. The fractional flow model specifies the fraction of material flow in the producer well that originated from the injector well and traveled through a specified inter-well connection. The computer system further provides the determined current efficiency of the inter-well connections to an injection/production controller, which regulates material flow through the injector well and/or the producer well according to the determined current material flow efficiency levels.

In another embodiment, a method is provided for quantifying a level of uncertainty in a connection-based model. A computer system receives sensor data from various hardware sensors disposed in a well, and determines connection strength factors and connection efficiency factors for each inter-well connection using a streamline-based estimation, a tracer-based estimation, or a heuristics-based estimation. The computer system generates an uncertainty factor for each connection efficiency factor using an a priori probability distribution function, where connection parameters for each inter-well connection are described as including certain connection parameter features. This avoids having deterministic values for the connection parameters.

The computer system also selects a set of samples from the a priori probability distribution function to identify a set of corresponding material flow rates for the producer wells using the described connection parameters, and discarding those samples in the set of samples that correspond to material flow rates that do not sufficiently match a historical rate corresponding to the producer wells. Then, for remaining samples for each inter-well connection, from the a posteriori probability distribution function of the inter-well connection parameters, the computer system translates a range of parameters that lead to a specified history-match into an uncertainty range for each inter-well connection. The computer system then forms an aggregate uncertainty range by combining the translated range of parameters for each inter-well connection, per well or per well group, and provides the formed uncertainty range to a controller, such that the controller controls the flow of injection or production materials in or from the well based on the aggregate uncertainty range.

In another embodiment, a computer system instantiates a user interface for visualizing inter-well connection strength and inter-well connection efficiency. The user interface includes multiple elements including a first element that illustrates an estimation of strength for each inter-well connection. The estimation of strength is generated using sensor data provided by hardware sensors disposed in a well. The sensor data is implemented in a stationary pressure equation that is subject to pressure or rate boundary conditions at the wells and reservoir boundaries. The estimation of strength is also generated by implementing a tracer algorithm that is subject to tracer concentration boundary conditions at the wells and reservoir boundaries, and further by post-processing a tracer solution resulting from the tracer algorithm to determine a level of fluid connectivity between two wells.

The user interface also includes a second element that illustrates an estimation of the efficiency of each inter-well connection obtained using an empirical fractional flow model or a physics-based model. The fractional flow model specifies the fraction of material flow in a producer well that originated from an injector well and traveled through a specified inter-well connection. The user interface also includes a third element representing the inter-well connection, where each connection between two wells is represented by a specified visual element between the two wells, and where the strength, efficiency or uncertainty of the connection is represented by a variation in color, shape, line thickness or line style of the specified visual element. Still further, a fourth element is includes which has a control element that allows material flow through the injector well and/or the producer well to be controlled according to the determined current inter-well connection efficiency.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be apparent to one of ordinary skill in the art from the description, or may be learned by the practice of the teachings herein. Features and advantages of embodiments described herein may be realized and obtained by means of the instruments and combinations particularly pointed out in the appended claims. Features of the embodiments described herein will become more fully apparent from the following description and appended claims.

BRIEF DESCRIPTION OF THE DRAWINGS

To further clarify the above and other features of the embodiments described herein, a more particular description will be rendered by reference to the appended drawings. It is appreciated that these drawings depict only examples of the embodiments described herein and are therefore not to be considered limiting of its scope. The embodiments will be described and explained with additional specificity and detail through the use of the accompanying drawings in which.

DETAILED DESCRIPTION

Figure 1:
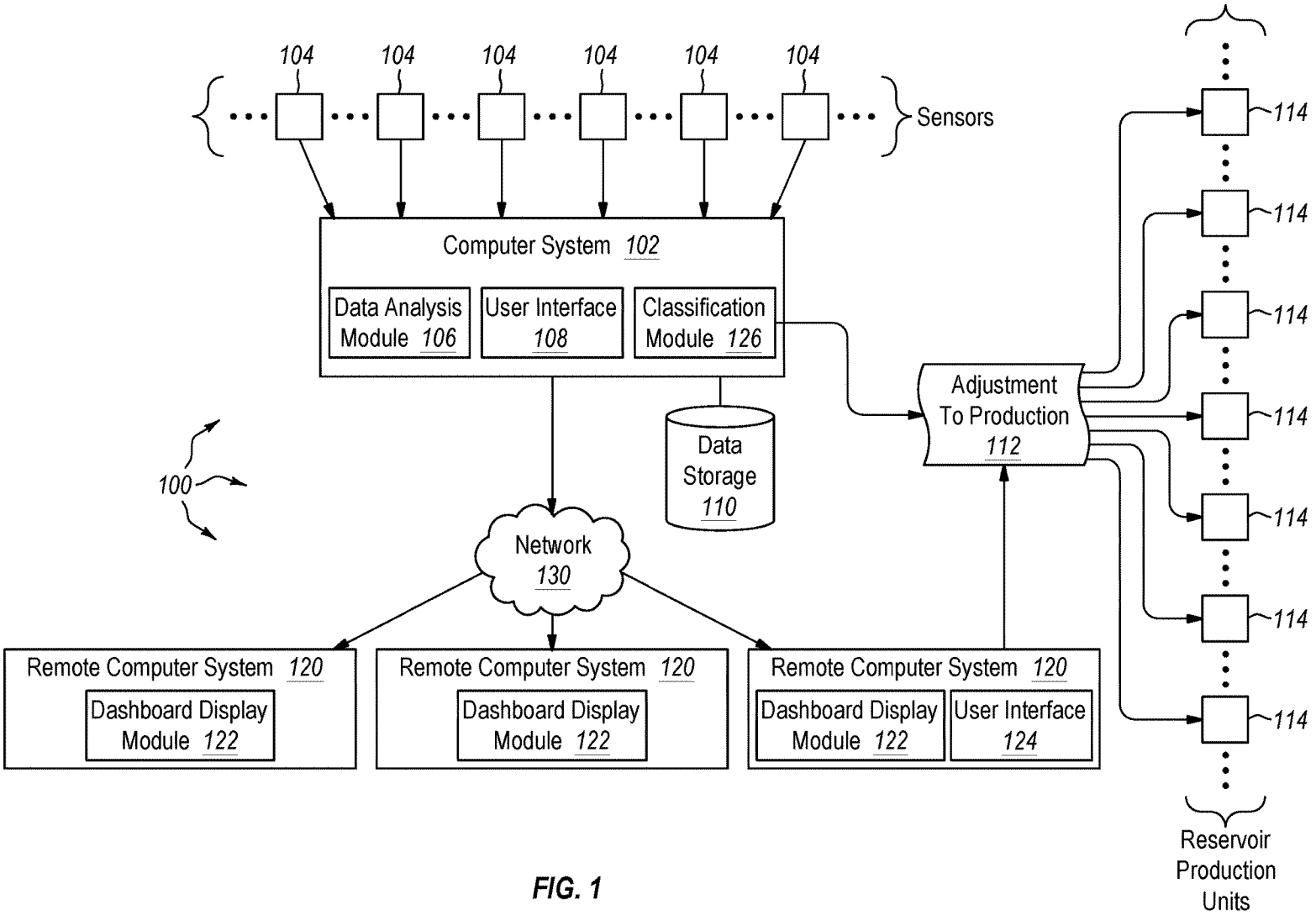
FIG. 1 illustrates a computer-implemented or computer-controlled architecture that can be used to gather, analyze and/or display data gathered from and about a reservoir.

Embodiments described herein are directed to measuring, modeling and controlling physical material flow relationships between injector wells and producer wells in a reservoir and to quantifying a level of uncertainty in a connection-based model. In one embodiment, a computer system receives sensor data from hardware-based sensors distributed in various locations within a reservoir. The sensor data indicates a material flow rate currently present at each sensor location. The computer system also calculates pressure distribution within the reservoir using a stationary pressure algorithm to identify variations of pressure at the various locations within the reservoir using the received sensor data. Next, the computer system applies the calculated pressure distribution as an input to a tracer algorithm for an injector well and for a producer well to identify tracer flow values for materials flowing from a seed point the injector well to the producer well. The tracer values provide an indication of material flow volume attributable to the seed point.

The computer system further combines the identified tracer flow values from the tracer algorithm to generate well allocation factors representing relationships in material flow through inter-well connections between the injector well and the producer well. These well allocation factors provide a measurement of material flow strength between wells. The computer system then determines a current material flow efficiency level of each inter-well connection using a fractional flow model that incorporates as input the determined material flow strength measurement. The fractional flow model specifies the fraction of material flow in the producer well that originated from the injector well and traveled through a specified inter-well connection. The computer system further provides the determined current efficiency of the inter-well connections to an injection/production controller, which regulates material flow through the injector well and/or the producer well according to the determined current material flow efficiency levels.

In another embodiment, a method is provided for quantifying a level of uncertainty in a connection-based model. A computer system receives sensor data from various hardware sensors disposed in a well, and determines connection strength factors and connection efficiency factors for each inter-well connection using a streamline-based estimation, a tracer-based estimation, or a heuristics-based estimation. The computer system generates an uncertainty factor for each connection efficiency factor using an a priori probability distribution function, where connection parameters for each inter-well connection are described as including certain connection parameter features. This avoids having deterministic values for the connection parameters.

The computer system also selects a set of samples from the a priori probability distribution function to identify a set of corresponding material flow rates for the producer wells using the described connection parameters, and discarding those samples in the set of samples that correspond to material flow rates that do not sufficiently match a historical rate corresponding to the producer wells. Then, for remaining samples for each inter-well connection, from the a posteriori probability distribution function of the inter-well connection parameters, the computer system translates a range of parameters that lead to a specified history-match into an uncertainty range for each inter-well connection. The computer system then forms an aggregate uncertainty range by combining the translated range of parameters for each inter-well connection, per well or per well group, and provides the formed uncertainty range to a controller, such that the controller controls the flow of injection or production materials in or from the well based on the aggregate uncertainty range.

In another embodiment, a computer system instantiates a user interface for visualizing inter-well connection strength and inter-well connection efficiency. The user interface includes multiple elements including a first element that illustrates an estimation of strength for each inter-well connection. The estimation of strength is generated using sensor data provided by hardware sensors disposed in a well. The sensor data is implemented in a stationary pressure equation that is subject to pressure or rate boundary conditions at the wells and reservoir boundaries. The estimation of strength is also generated by implementing a tracer algorithm that is subject to tracer concentration boundary conditions at the wells and reservoir boundaries, and further by post-processing a tracer solution resulting from the tracer algorithm to determine a level of fluid connectivity between two wells.

The user interface also includes a second element that illustrates an estimation of the efficiency of each inter-well connection obtained using an empirical fractional flow model or a physics-based model. The fractional flow model specifies the fraction of material flow in a producer well that originated from an injector well and traveled through a specified inter-well connection. The user interface also includes a third element representing the inter-well connection, where each connection between two wells is represented by a specified visual element between the two wells, and where the strength, efficiency or uncertainty of the connection is represented by a variation in color, shape, line thickness or line style of the specified visual element. Still further, a fourth element is includes which has a control element that allows material flow through the injector well and/or the producer well to be controlled according to the determined current inter-well connection efficiency.

The following discussion refers to a number of methods and method acts that may be performed by one or more embodiments of the subject matter disclosed herein. It should be noted, that although the method acts may be discussed in a certain order or illustrated in a flow chart as occurring in a particular order, no particular ordering is necessarily required unless specifically stated, or required because an act is dependent on another act being completed prior to the act being performed.

Embodiments described herein may implement various types of computing systems. These computing systems are now increasingly taking a wide variety of forms. Computing systems may, for example, be mobile phones, electronic appliances, laptop computers, tablet computers, wearable devices, desktop computers, mainframes, and the like. As used herein, the term "computing system" includes any device, system, or combination thereof that includes at least one processor, and a physical and tangible computer-readable memory capable of having thereon computer-executable instructions that are executable by the processor. A computing system may be distributed over a network environment and may include multiple constituent computing systems.

A computing system typically includes at least one processing unit and memory. The memory may be physical system memory, which may be volatile, non-volatile, or some combination of the two. The term "memory" may also be used herein to refer to non-volatile mass storage such as physical storage media or physical storage devices. If the computing system is distributed, the processing, memory and/or storage capability may be distributed as well.

As used herein, the term "executable module" or "executable component" can refer to software objects, routines, methods, or similar computer-executable instructions that may be executed on the computing system. The different components, modules, engines, and services described herein may be implemented as objects or processes that execute on the computing system (e.g., as separate threads).

As described herein, a computing system may also contain communication channels that allow the computing system to communicate with other message processors over a wired or wireless network. Such communication channels may include hardware-based receivers, transmitters or transceivers, which are configured to receive data, transmit data or perform both.

Embodiments described herein also include physical computer-readable media for carrying or storing computer-executable instructions and/or data structures. Such computer-readable media can be any available physical media that can be accessed by a general-purpose or special-purpose computing system.

Computer storage media are physical hardware storage media that store computer-executable instructions and/or data structures. Physical hardware storage media include computer hardware, such as RAM, ROM, EEPROM, solid state drives ("SSDs"), flash memory, phase-change memory ("PCM"), optical disk storage, magnetic disk storage or other magnetic storage devices, or any other hardware storage device(s) which can be used to store program code in the form of computer-executable instructions or data structures, which can be accessed and executed by a general-purpose or special-purpose computing system to implement the disclosed functionality of the embodiments described herein. The data structures may include primitive types (e.g. character, double, floating-point), composite types (e.g.

array, record, union, etc.), abstract data types (e.g. container, list, set, stack, tree, etc.), hashes, graphs or other any other types of data structures.

As used herein, computer-executable instructions comprise instructions and data which, when executed at one or more processors, cause a general-purpose computing system, special-purpose computing system, or special-purpose processing device to perform a certain function or group of functions. Computer-executable instructions may be, for example, binaries, intermediate format instructions such as assembly language, or even source code.

Those skilled in the art will appreciate that the principles described herein may be practiced in network computing environments with many types of computing system configurations, including, personal computers, desktop computers, laptop computers, message processors, hand-held devices, multi-processor systems, microprocessor-based or programmable consumer electronics, network PCs, mini-computers, mainframe computers, mobile telephones, PDAs, tablets, pagers, routers, switches, and the like. The embodiments herein may also be practiced in distributed system environments where local and remote computing systems, which are linked (either by hardwired data links, wireless data links, or by a combination of hardwired and wireless data links) through a network, both perform tasks. As such, in a distributed system environment, a computing system may include a plurality of constituent computing systems. In a distributed system environment, program modules may be located in both local and remote memory storage devices.

Those skilled in the art will also appreciate that the embodiments herein may be practiced in a cloud computing environment. Cloud computing environments may be distributed, although this is not required. When distributed, cloud computing environments may be distributed internationally within an organization and/or have components possessed across multiple organizations. In this description and the following claims, "cloud computing" is defined as a model for enabling on-demand network access to a shared pool of configurable computing resources (e.g., networks, servers, storage, applications, and services). The definition of "cloud computing" is not limited to any of the other numerous advantages that can be obtained from such a model when properly deployed.

Still further, system architectures described herein can include a plurality of independent components that each contribute to the functionality of the system as a whole. This modularity allows for increased flexibility when approaching issues of platform scalability and, to this end, provides a variety of advantages. System complexity and growth can be managed more easily through the use of smaller-scale parts with limited functional scope. Platform fault tolerance is enhanced through the use of these loosely coupled modules. Individual components can be grown incrementally as business needs dictate. Modular development also translates to decreased time to market for new functionality. New functionality can be added or subtracted without impacting the core system.

FIG. 1 illustrates a computer-implemented architecture in which a computer-implemented petroleum production and monitoring system 100 may operate. The computer-implemented petroleum production monitoring system 100 may be configured to monitor reservoir performance, analyze information regarding reservoir performance, display dashboard metrics, and optionally provide for computer-controlled modifications to maintain optimal oil well performance. Production and monitoring system 100 may include a main data gathering computer system 102 comprised of one or more computers (potentially located near a reservoir) which are linked to reservoir sensors 104 positioned at one or more petroleum reservoirs. Each of these computers typically includes at least one processor and system memory. Computer system 102 may comprise a plurality of networked computers (e.g., each of which is designed to analyze a subset of the overall data generated by and received from the sensors 104).

Reservoir sensors 104 are typically positioned at different locations within one or more producing oil wells, and may include both surface and sub-surface sensors. Sensors 104 may also be positioned at one or more water injection wells, observation wells, etc. The reservoir sensors 104 may include pressure sensors, fluid or gas flow sensors, altitude or depth sensors, temperature sensors, or other types of digital or analog sensors. The geophysical data gathered by the sensors 104 can be used to generate performance metrics (e.g., leading and lagging indicators of production and recovery). The computer system 102 may therefore include a data analysis module 106 programmed to generate metrics from the received sensor data. A user interface 108 provides interactivity with a user, including the ability to input data relating to areal displacement efficiency, vertical displacement efficiency, and pore displacement efficiency. Data storage device 110 can be used for long-term storage of data and metrics generated from the data.

According to one embodiment, the computer system 102 can provide for at least one of manual or automatic adjustment to production 112 by reservoir production units 114 (e.g., producing oil wells, water injection wells, gas injection wells, heat injectors, and the like, and sub-components thereof). Adjustments might include, for example changes in volume, pressure, temperature, well bore path (e.g., via closing or opening of well bore branches). The user interface 108 permits manual adjustments to production 112. The computer system 102 may in addition include alarm levels or triggers that, when certain conditions are met, provide for automatic adjustments to production 112.

Monitoring system 100 may also include one or more remote computers 120 that permit a user, team of users, or multiple parties to access information generated by main computer system 102. For example, each remote computer 120 may include a dashboard display module 122 that renders and displays dashboards, metrics, or other information relating to reservoir production. Each remote computer 120 may also include a user interface 124 that permits a user to make adjustment(s) to production 112 by reservoir production units 114. Each remote computer 120 may also include a data storage device similar to or the same as data storage 110.

Individual computer systems within monitoring system 100 (e.g., main computer system 102 and remove computers 120) can be connected to a network 130, such as, for example, a local area network ("LAN"), a wide area network ("WAN"), or even the Internet. The various components can receive and send data to each other, as well as other components connected to the network. Networked computer systems (i.e. cloud computing systems) and computers themselves constitute a "computer system" for purposes of this disclosure.

Networks facilitating communication between computer systems and other electronic devices can utilize any of a wide range of (potentially interoperating) protocols including, but not limited to, the IEEE 802 suite of wireless protocols, Radio Frequency Identification ("RFID") protocols, ultrasound protocols, infrared protocols, cellular protocols, one-way and two-way wireless paging protocols, Global Positioning System ("GPS") protocols, wired and wireless broadband protocols, ultra-wideband "mesh" protocols, etc. Accordingly, computer systems and other devices can create message related data and exchange message related data (e.g., Internet Protocol ("IP") datagrams and other higher layer protocols that utilize IP datagrams, such as, Transmission Control Protocol ("TCP"), Remote Desktop Protocol ("RDP"), Hypertext Transfer Protocol ("HTTP"), Simple Mail Transfer Protocol ("SMTP"), Simple Object Access Protocol ("SOAP"), etc.) over the network.

Computer systems and electronic devices may be configured to utilize protocols that are appropriate based on corresponding computer system and electronic device on functionality. Components within the architecture can be configured to convert between various protocols to facilitate compatible communication. Computer systems and electronic devices may be configured with multiple protocols and use different protocols to implement different functionality. For example, a sensor 104 at an oil well might transmit data via wire connection, infrared or other wireless protocol to a receiver (not shown) interfaced with a computer, which can then forward the data via fast Ethernet to main computer system 102 for processing. Similarly, the reservoir production units 114 can be connected to main computer system 102 and/or remote computers 120 by wire connection or wireless protocol.

Figure 2:
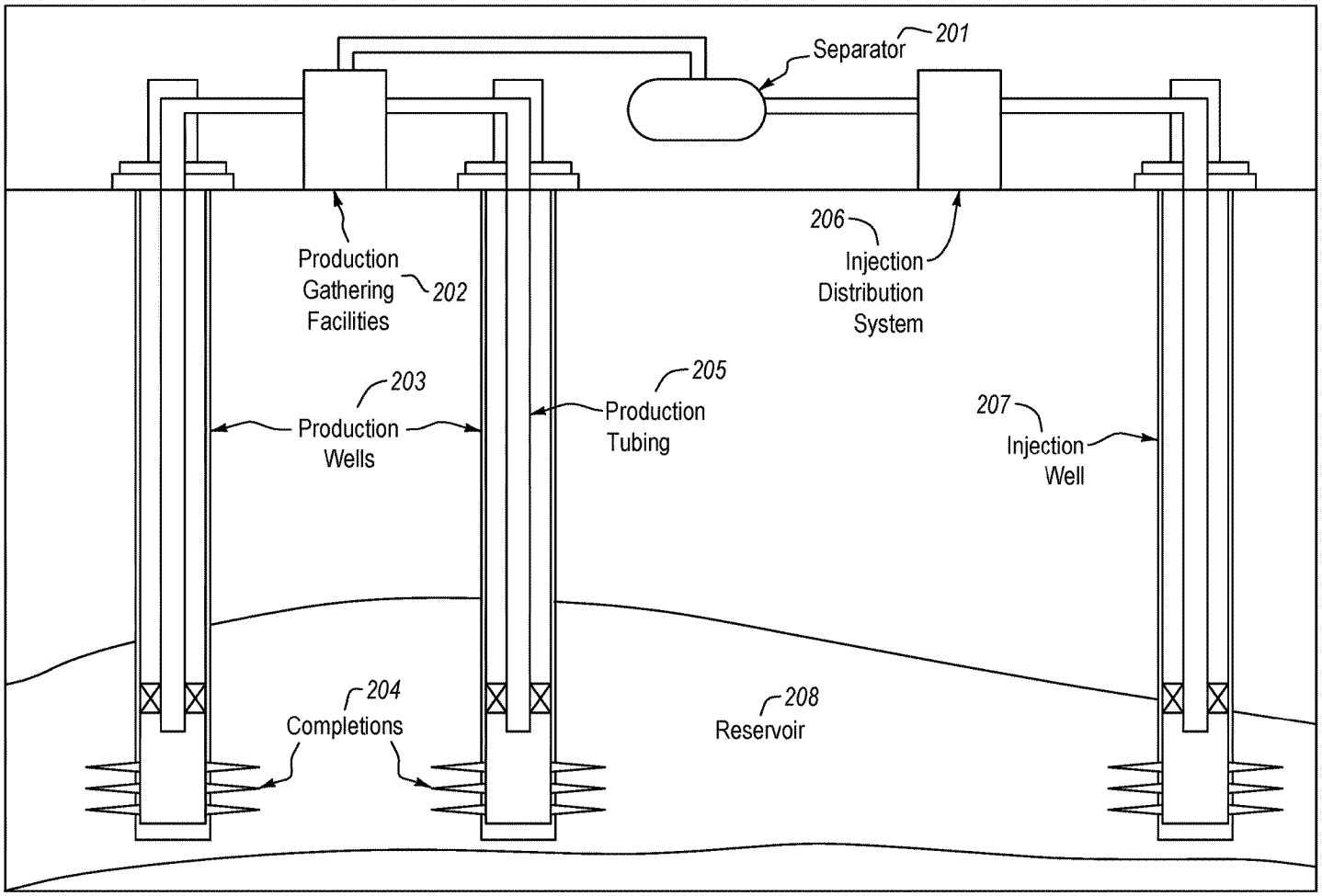
FIG. 2 illustrates an example schematic of a production and injection system of a petroleum field.

FIG. 2 illustrates a schematic of a production and injection system of a petroleum field. The production wells 203 allow reservoir fluids (from reservoir 208) to flow through their completion 204 and to the surface, where a network of pipelines (e.g. production tubing 205) carry the fluids to production gathering facilities 202, and in turn, to a separator 201. The separator system isolates each fluid phase (typically oil, gas and water). In some cases, the water or gas produced and separated are then sent to an injection distribution system 206. The injection distribution system can also receive injection fluids from exterior sources. The injection wells 207 receive the fluids to be injected from the injection distribution system 206 via a network of pipelines and inject these fluids in the petroleum reservoirs through well completions 204.

In some embodiments, reservoir fluid mixtures may be composed of two or more phases including oil, water or gas. The reservoirs themselves may be composed of multiple different tanks or tank blocks. These tank blocks may each have different physical properties. For example, the tank blocks may have formed in different manners geologically. The tanks may include different amounts of oil, gas, water or other materials. Still further, the tank blocks may be subject to different pressures owing to the different materials, different material amounts, or other forces such as the injection of fluids in adjacent or neighboring tanks. Moreover, each well in a reservoir may have stronger or weaker connections to other wells in the reservoir. Accordingly, in such cases a computer system (e.g. 301 of FIG. 3) may be used to model physical material flow relationships between wells in a reservoir, including connections between injector wells and producer wells and between wells and aquifers.

Figure 3:
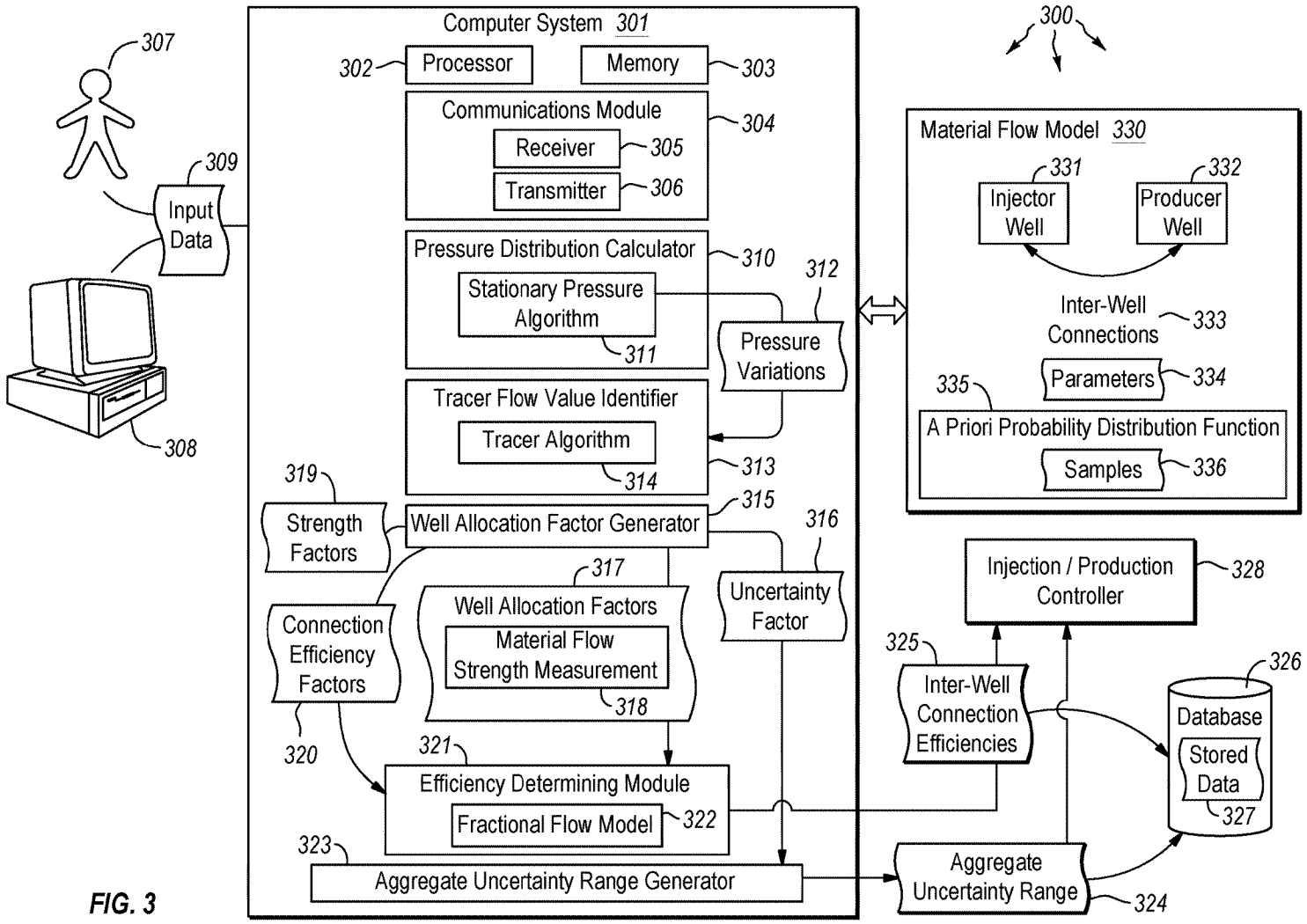
FIG. 3 illustrates a computer architecture in which embodiments described herein may operate including modeling physical material flow relationships between injector wells and producer wells in a reservoir.

FIG. 3 illustrates a computer architecture 300 in which various embodiment described herein may be employed. The computer architecture 300 includes a computing system 301. As described above with reference to computer system 102 of FIG. 1, the computing system 301 may be any type of local or distributed computing system, including a cloud computing system. The computing system 301 includes a hardware processor 302 and hardware memory 303, along with other hardware and/or software modules for performing different functions. For instance, the communications module 304 may be configured to communicate with other computing systems using a hardware receiver 305 and/or a hardware transmitter 306. The communications module 304 may include any wired or wireless communication means that can receive and/or transmit data to or from other computing systems. The communications module 304 may be configured to interact with databases, mobile computing devices (such as mobile phones or tablets), embedded or other types of computing systems. Other modules will be described in conjunction with FIGS. 4-11 below.

Figure 4:
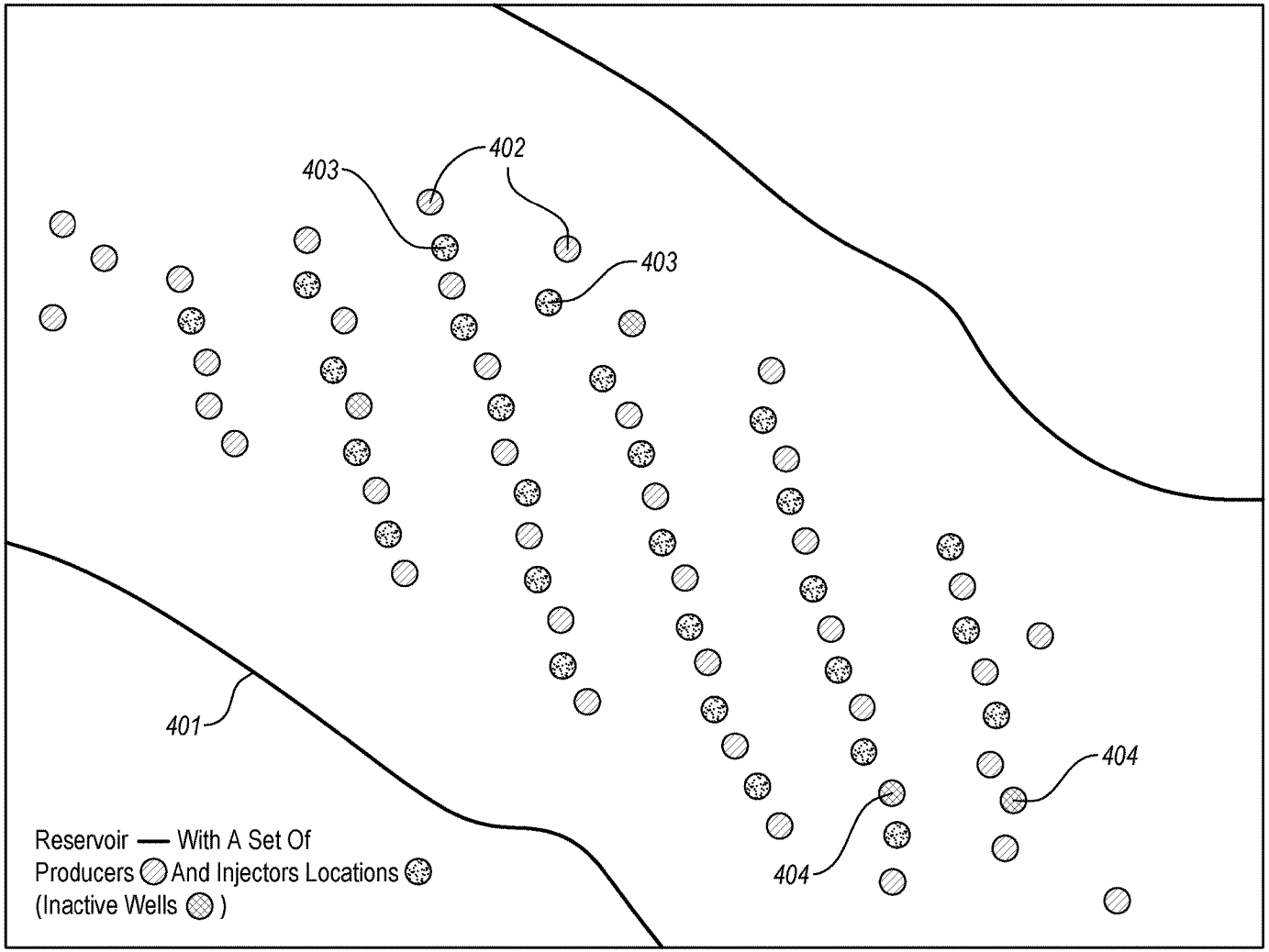
FIG. 4 illustrates a reservoir with producer and injector well locations, along with inactive wells.

The computer system 301 may receive input data 309 from users such as user 307 or from other computer systems 308, such as via a network. The communications module 304 may receive these inputs and call upon the processor 302 to process and interpret the inputs 309. In some cases, the input data may be related to pressure distribution among wells in a reservoir. FIG. 4, for example, illustrates a generic petroleum reservoir 401 under secondary recovery. As used herein, "secondary recovery" refers to a reservoir in which water or gas is being injected to displace the oil or other materials being recovered. In FIG. 4, the reservoir boundary is displayed in a solid black line (401). The producing wells are presented in dotted lines (402), the injecting wells are presented in dashed lines (403), and the inactive wells are presented in slashed lines (404). As can be seen, the reservoir 401 may include many different injecting and producing wells, along with one or more inactive wells.

The pressure distribution calculator 310 of FIG. 3 may be used to calculate or otherwise identify how pressure is distributed among the different wells (e.g. 402 and 403) in reservoir 401. The pressure distribution calculator 310 may implement a stationary pressure algorithm 311 to calculate pressure variations 312 between specified injector and/or producer wells. For instance, the pressure distribution calculator 310 may use stationary pressure algorithm 311 to calculate pressure variations 312 between injector well 331 and producer well 332, based on input data obtained from these wells regarding inter-well connections 333 and associated parameters 334.

Figure 5:
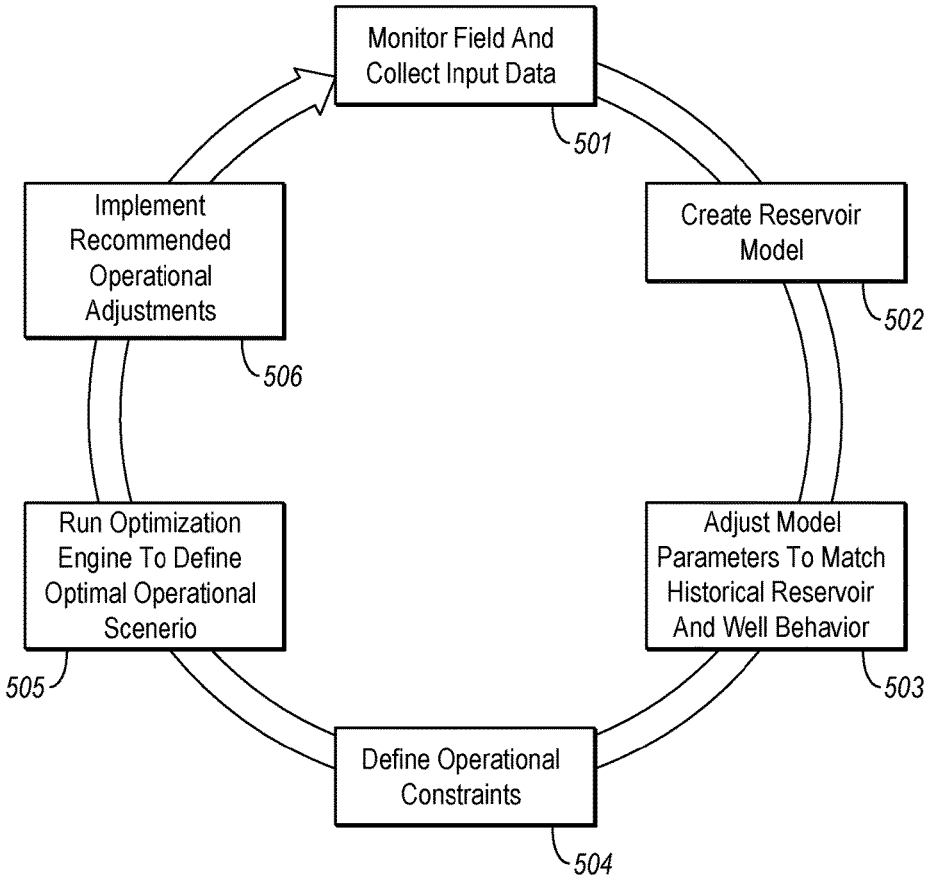
FIG. 5 illustrates a workflow for providing updates to material production operations.

In one general embodiment, outlined in FIG. 5, a workflow is provided for updating well or reservoir studies. In step 501, the production, injection, pressure and other operational data are collected on a field (e.g. an oil field) using various surveillance methodologies and technologies. In step 502, a connection-based reservoir model (e.g. 330 of FIG. 3) is created or updated. Then, in step 503, model parameters 334 are calibrated to the newly expanded dataset, so that the model adequately reproduces the well and reservoir behavior that was historically observed. Next, in step 504, various operational constraints are defined that should be considered during each iteration. The constraints are then imported into an optimization engine, along with the calibrated model 330. The optimization engine delivers a set of recommended adjustments to the current operational strategy in step 505. Finally, in step 506, the adjustments are implemented in the field, and the cycle starts again.

Figure 6:
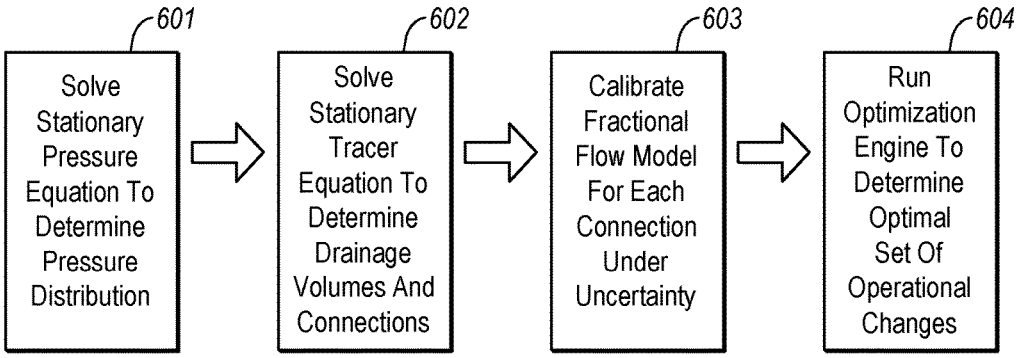
FIG. 6 illustrates a computational process flow for determining an optimal set of operational changes.

FIG. 6 identifies different steps in the computational workflow of one or more embodiments described herein. First, in step 601, the stationary pressure algorithm 311 is implemented to obtain an estimation of the current pressure distribution (e.g. 312) in the field (i.e. among wells 331 and 332). In step 602, the pressure variations are then used to determine, using a stationary tracer algorithm 314, the connection strength between each well pair and each well and the aquifer. In the next step 603, a fractional flow model 322 is calibrated for each connection automatically and under uncertainty. Finally, in step 604, an optimization algorithm is run to determine the optimal controls to enforce on the field. These controls may be provided to the injection/production controller 328, which may regulate or control material flow through the injector well 331 and/or the producer well 332. In at least some embodiments, the determined controls are fed to the controller 328 automatically, and are used to automate control of material flow through the wells according to the various computations.

The computer system 301 of FIG. 3 also includes a well allocation factor generator 315. Well allocation factors 317 may include any data or parameters associated with inter-well connections including amount of material flow between wells, rate of material flow between wells, total amount of material in wells, and other data. Indeed, in one embodiment, the well allocation factors 317 may include or provide indications of a material flow strength measurement 318. Various factors may go into the material flow strength measurement 318 including connection strength factors 319 and connection efficiency factors 320.

Figure 7:
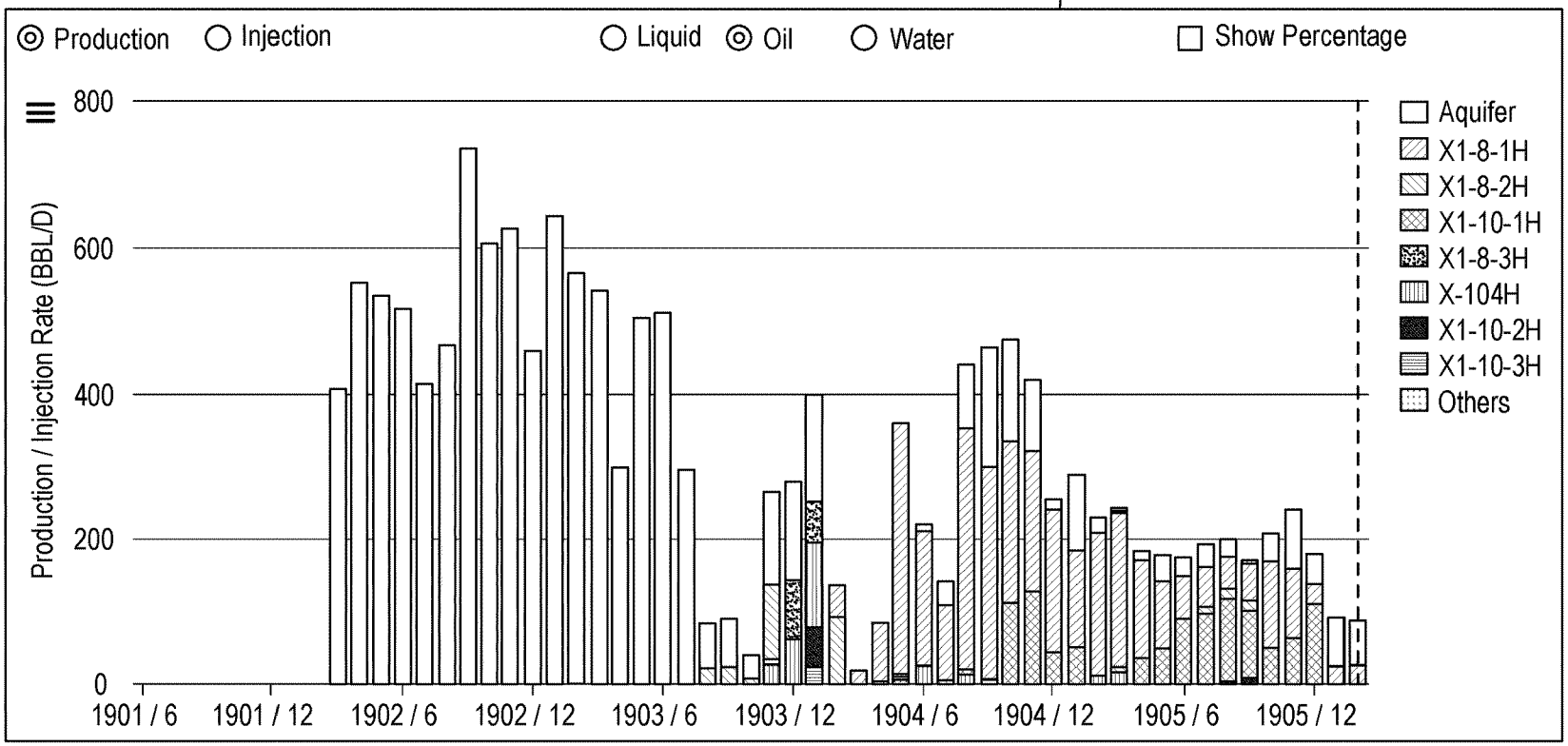
FIG. 7 illustrates a variation of well allocation factors for a specified producer well.

FIG. 7 illustrates presents a graph of well allocation factors. The graph 701 shows connection strength, over time, between a producer well and other wells. The strong initial dependence on the aquifer, during the primary depletion phase, is quickly replaced by the influence of nearby injection wells. As production and injection controls change from month to month (i.e. the input or output material flow rate), the connection strength between wells may change dramatically. Accordingly, in the embodiments herein, inter-well connection strength is modeled as a dynamic variable, and not a simple static one.

Figure 8:
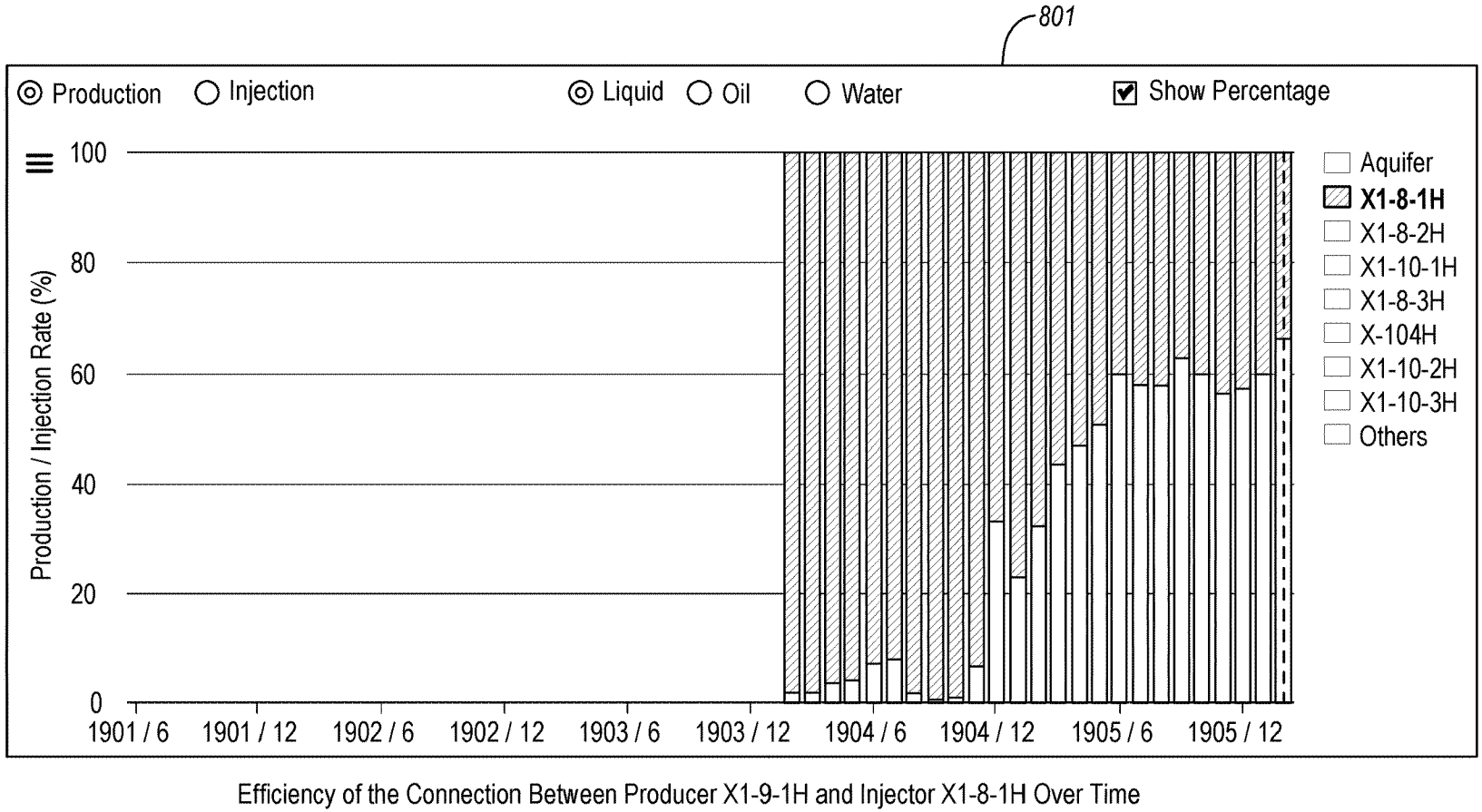
FIG. 8 illustrates a graph of connection efficiency between a producer well and an injector well over time.

The computer system 301 of Figure further includes an efficiency determining module 321 that implements a fractional flow model 322 to determine the efficiency of inter-well connections 325. FIG. 8 presents the variation over time 801 of the connection efficiency between a producer well and an injector well. The connection efficiency is represented by the solid area on the chart. The decreasing efficiency over time is indicative of the progressive water encroachment from the injector to the producer.

Figure 9:
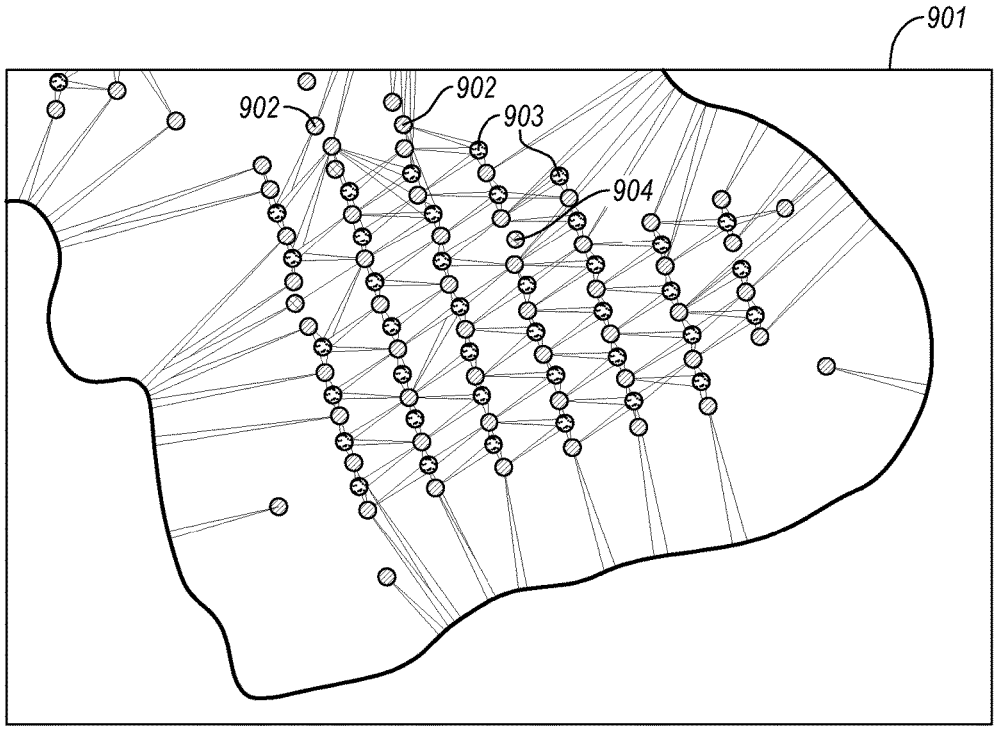
FIG. 9 illustrates a visualization of inter-well and well-aquifer connections in a group of wells.

FIG. 9 illustrates a top-view 901 of a reservoir map, showing the locations of the producers (dashed line dots 903) and injectors (dotted line dots 902) as well as the wells that are currently inactive (slashed line dots 904). The connections that have been identified between wells or between a well and the aquifer are represented by the pointed lines or arrows that are pointing from the source of the pressure support (aquifer or injector) to the pressure sink (producer or injector).

Figure 10:
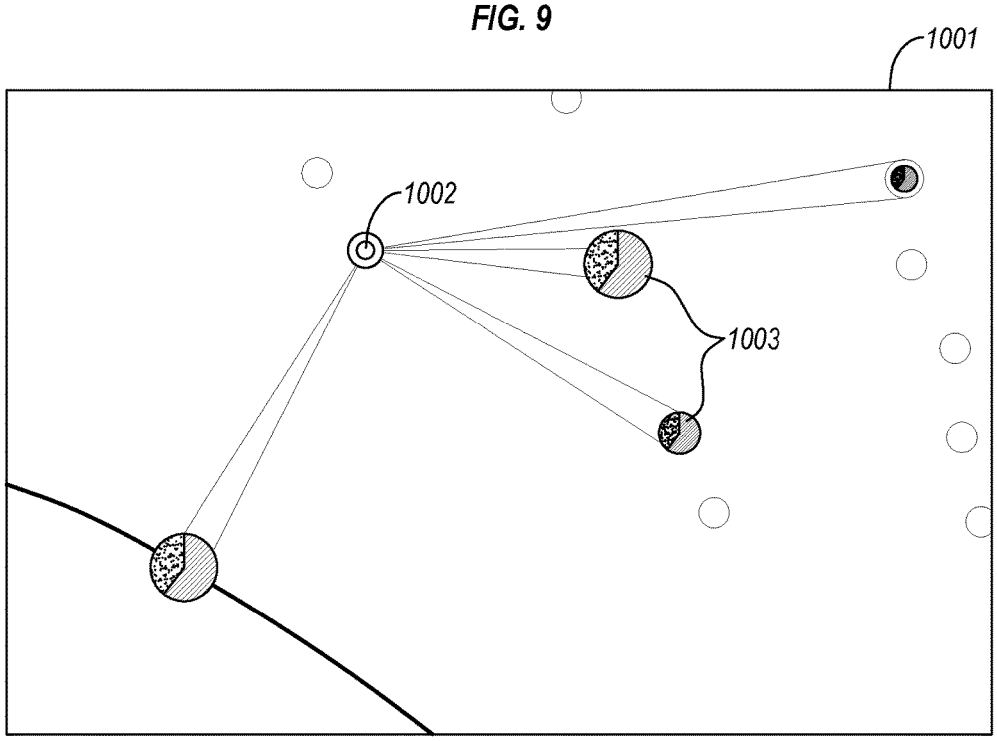
FIG. 10 illustrates a visualization of inter-well and well-aquifer connections for a specified well.
Figure 11:
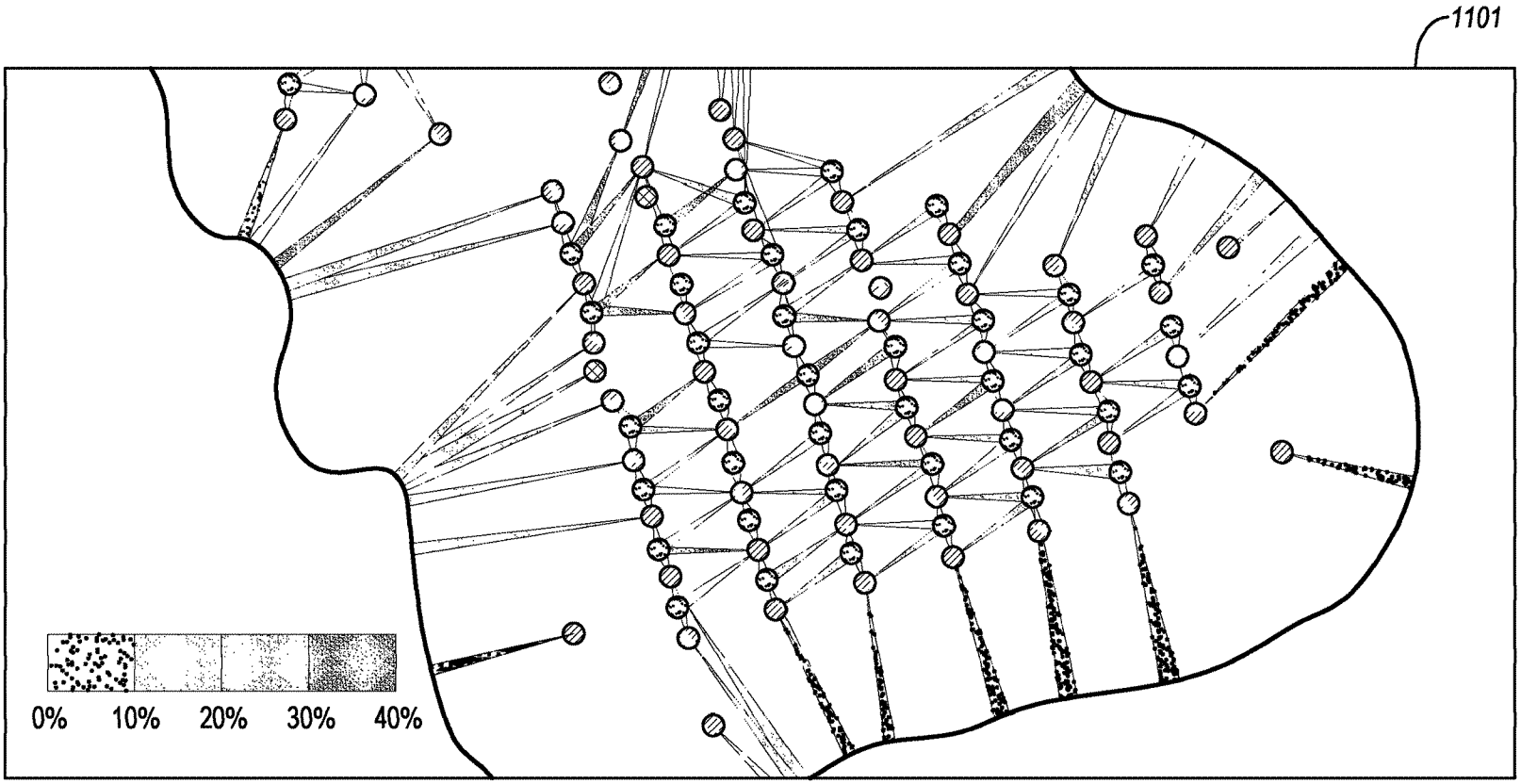
FIG. 11 illustrates a visualization of uncertainty in inter-well and well-aquifer connections efficiency.

FIG. 10 illustrates a top view visualization 1001 of a reservoir, where a well of interest 1002 is centrally located, and the pie charts 1003 describe the strength and efficiency of the connection with each one of the connected wells and aquifer. This will be described further below. FIG. 11 is a variation of FIG. 9, in which all the connection arrows may be colored in different colors based on the uncertainty level of each connection. The uncertainty level of each color is given by the color legend in the lower left corner of the figure. In this particular example, a first color of arrows represents a high uncertainty in connection efficiency, while a second color of arrows corresponds to low uncertainty. As with FIG. 10, this will be described below, especially with regard to methods 1200 and 1300 of FIGS. 12 and 13.

The embodiments described herein may be used to monitor and optimize petroleum reservoirs exploited by secondary recovery methods. A combination of reduced-physics models and data-driven methods are described which allow the computing systems described herein to model reservoirs in a fast and accurate manner, and to deliver recommendations on how to improve the performance of fields. When using these models and methods, users may gain insights into how the various wells in the field are connected through the subsurface, and how to alter the operational strategy to improve field behavior. For example, these models and methods may be used on various projects to increase oil production and reduce unwanted water production and ineffective water injection.

In order to deliver accurate results quickly, the systems herein have been designed to account for the physics at play in secondary recovery projects but to minimize or neglect at least some of the physics creating lower-order effects. Unlike classical reservoir simulation models which may take months to be built and calibrated and hours to run, the models described herein can be created in days or hours, updated in hours or minutes and run in seconds. As such, these systems can be processed quickly enough for use by fast-paced operational teams. As the models can be processed in substantially less time, fewer physical processing resources may be used to achieve the result. Accordingly, the models and systems described herein represent a tangible reduction in computing resources including processing time, memory and storage.

The workflow represented in FIG. 5 and can be segmented in six principal steps: monitor field and collect input data (501), create the reservoir model (502), adjust model parameters (503), define operational constraints (504), run optimization (505) and implement recommended operational adjustments (506). When operating secondary recovery projects, a variety of data is routinely collected to analyze the current condition of the field and decide how to improve its behavior. This data may be provided as input data 309 to computer system 301 of FIG. 3. Production and injection rates, pressures, production ratios such as water cuts or gas-oil ratios, well logs, and other data are all examples of measurements that may be collected as part of a surveillance plan.

The systems and models described herein (or simply "the system") may implement two types of data: reservoir characterization data and operational data. Reservoir characterization data can include seismic surveys, well logs, core samples, etc. and is interpreted to yield a geologic model that provides an interpretation of the structural, stratigraphic and petrophysical nature of the reservoir. The geologic model is presented in the form of a grid on which rock and fluid properties are defined. The model (e.g. 330) is complemented with the wells that are described using their trajectories and completion data.

In addition to the reservoir model, the system uses an operational dataset to describe the historical production and injection rate of each well and associated pressures. In some cases, additional data may be available such as tracer or interference tests that can be used to validate the results of the inter-well connections computed by the system.

The first step in a building such a reservoir model is to quantify the strength of each connection between two wells (e.g. between injector well 331 and producer well 332) or between a well and the aquifer. To do so, the flow behavior of the reservoir is estimated and quantified in terms of connections. The system follows the process described below to achieve that goal.

First, a stationary pressure algorithm 311 is solved. The flow of petroleum fluids is governed by a mass conservation equation that reads $$\frac{\partial}{\partial t}(\rho\phi) + \nabla \cdot \left(\frac{1}{\mu} K \cdot \nabla p\right) + q = 0, \quad \text{(Eq. 1)}$$

where ρ and μ are the fluid density and viscosity, ϕ and K are the rock porosity and permeability, p is the fluid pressure and q is a volumetric source or sink term, which essentially represents the production or injection from wells. The stationary pressure equation may be completed with boundary conditions that can, for example, represent the influence of an aquifer. Boundary conditions can be set as pressure (Dirichlet-type) or rate (Neumann-type) to account for various aquifer considerations.

The stationary form of this equation (e.g. 311) describes the flow problem in a steady-state situation. The stationary equation 311 is obtained by neglecting the accumulation term in (Eq. 1), since the term is a time derivative that vanishes in a steady-state situation:

$$\nabla \cdot \left(\frac{1}{\mu} K \cdot \nabla p\right) + q = 0, \quad \text{(Eq. 2)}$$

For complex fluids that are composed of multiple chemical components and can appear in several phases, the phase saturations are introduced as additional unknowns that describe the volumetric proportion of each fluid in the pore space. Conservation equations similar to (Eq. 1) and (Eq. 2) are written for each fluid component and form a system of equation pressure and saturations. One manipulation of this system can yield a single pressure equation, describing a flow problem and a set of saturation equations, describing a transport problem. In stationary form, the multi-phase pressure equation takes a form similar to (Eq. 1), differentiated in that the viscosity term is then replaced by a total mobility term accounting for the aggregate viscosity and relative permeability of each fluid phase. The pressure and source terms are also modified to account for all material phases.

Next, a simulation grid is generated that discretizes the reservoir volume. The system may implement a geologic model grid or a derived grid generated through upscaling. The stationary pressure equation is then discretized onto the grid and the problem can be solved numerically using algorithms including a finite-difference or finite-volume method to obtain an estimation of the pressure in each grid cell. In some embodiments, the system may use the flow rates of existing wells and the characteristics of the aquifer as boundary conditions to solve the stationary pressure equation and obtain a description of the spatial variation of pressure in the reservoir.

The pressure solution (312) is then post-processed using a tracer equation (314) in order to determine the amount of fluid that is being carried from one well to another or from one well to or from the aquifer. The stationary tracer concentration equation for a single-phase incompressible system reads $$u \cdot (\nabla C) = 0, \quad \text{(Eq. 3)}$$

where u is Darcy velocity of the fluid, and C is concentration of a tracer. The Darcy velocity is simply obtained by post-processing the pressure solution using Darcy's law.

The solution of the stationary tracer equation 314 provides an estimated concentration of a tracer that would propagate following the pressure field after an infinite time from a seed point within the reservoir defined by the boundary conditions. As such, the tracer concentration provides an estimation of the reservoir volume that is connected to that seed point. By seeding the tracers strategically at producers and injectors, the system can determine the volume of fluid that is hydraulically connected to the well pair. Similarly, the volume of fluid that is hydraulically connected to an aquifer can also be determined in this manner. The determined volume of fluid can then be translated into a connection strength or well allocation factor 315, which describes the proportion of the fluid flowing through a producer (or injector) that is connected to the aquifer or to a specific injector (or producer).

The connection strength (318) between two wells i and j may thus be quantified as a percentage number and designated by Well Allocation Factor between i and j or $WAF_{ij}$. The aquifer can also be understood as a producing/injecting well and can be represented in a similar fashion by i or j. The well allocation factor at well i associated with well j represents the concentration of the tracer at well i introduced into the field through well j. It can also be understood as the ratio of the liquid flow rate between these two wells to the liquid rate at well i at reservoir conditions.

The connection strength 318 defines the total volume of liquid that is being carried between two wells. The connection efficiency 325 describes the proportion of each fluid carried by the connection. The system may use a reservoir engineering method, known as fractional flow modeling (FFM), to quantify the historical efficiency of a connection. FFM may be used to describe the evolution of the proportion of fluid being produced at one end of a system and during injection at the other end of the system. FFM may be used, for example, in core analysis to model the fluids being produced at one end of an oil-filled core when flooded with water at the other end. In embodiment herein, FFM is used to represent the fraction of the various fluids flowing in a producer that originated from a specific injector and traveled through a connection. For simplicity and without loss of generality, the connection efficiency is presented based on the oil fractional flow, but the method can be described with any other fluid phases. The system has the ability to consider water and gas fractional flow models in addition to the basic oil model.

The system may define a fractional flow function on each inter-well connection. The efficiency of a connection is defined as the proportion of oil to total fluid flowing along the connection. By summing the contribution of each injector, the oil fraction $f_{o,j}^n$ of producer j can be expressed at the $n^{th}$ time step as:

$$f_{o,j}^n = \sum_{i=0}^{N_{inj}} WAF_{ji}^n G_{ij}^n,\ i = 0, 1, \ldots, N_{inj};\ j = 1, \ldots, N_{prd} \quad \text{(Eq. 4)}$$

where $WAF_{ji}^n$ is the fraction of the total fluid rate of producer j supported by injector i, and $G_{ij}^n$ is the oil fractional flow function of the connection between injector i and producer j. As used herein, i=0 may be used to describe the aquifer. The oil fraction can be used to evaluate the oil production rate through a simple multiplication with the total fluid production rate of a well:

$$q_{o,j}^n = f_{o,j}^n q_j^n, \quad \text{(Eq. 5)}$$

where $q_{o,j}^n$ and $q_{o,j}^n$ are the oil and total fluid rates of producer j and the $n^{th}$ time step, respectively.

The functions $G_{ij}^n$ depend on the historical well controls (i.e. injection rate at injectors and liquid production rate at producers) and can take a variety of forms. Any or all of these forms may be used in the embodiments herein. One of the models used herein is an adaptation of the fractional flow function as follows:

$$G_{ij}^n = \begin{cases} \dfrac{1}{1 + a_{ij}(n \cdot AqCon_j)^{b_{ij}}}, & i = 0;\ j = 1, \ldots, N_{prd} \\ \dfrac{1}{1 + a_{ij}(WIC_{ij}^n)^{b_{ij}}}, & i = 1, 2, \ldots, N_{inj};\ j = 1, \ldots, N_{prd} \end{cases} \quad \text{(Eq. 6)}$$

where $AqCon_j$ is the aquifer contribution to producer j at each time step; $WIC_{ij}^n$ is the cumulative water injection from injector i to producer j from $t_0$ to $t_n$. The expression of $WIC_{ij}^n$ is:

$$WIC_{ij}^n = \sum_{m=1}^{n} WAF_{ij}^m wWIC_i^m + IWIC_{ij}, \quad \text{(Eq. 7)}$$

where $WIC_{ij}^n$ is fraction of the total injection from injector i that is directed to producer j; $wWIC_i^m$ is the cumulative water injection of injector i from $t_{m-1}$ to $t_m$; $IWIC_{ij}$ is the initial cumulative water injection between injector i and producer j, which is a calibration parameter for each well pair.

Other definitions of $G_{ij}^n$ may also be used in the systems and models herein. These functions can be changed to better adapt to specific reservoirs. The series of $G_{ij}^n$ functions belong to the same class of functions, defined parametrically. These functional families can, for example, be an exponential family or an inverse polynomial as in Eq. 6. To define a specific function within that family it may be sufficient to define its parameters. Once the values of those parameters are determined for each connection, the fractional flow model is fully described.

The process of calibration includes finding a set of functional parameters by minimizing the mismatch between the model and the historical production. In the systems and models herein, the calibration may be performed with an optimization algorithm that adjusts the model parameters to minimize the model mismatch.

The modeling system described herein simplifies subsurface physics to obtain a fast estimation of inter-well and well-aquifer connectivity. The quick estimation of these connections is an advantage of this system. The system provides users with key information used to guide operations. The main operational action that users can take on a secondary recovery project is to alter the well controls in order to improve the field performance. Producers are usually controlled at the surface by chokes, or in the wellbore by pumps or gas-lift systems. The surface choke settings, pump control parameters such as pumping frequency or the gas-lift rates are all parameters that can be adjusted to modify the liquid production rate of a well (e.g. using controller 328). Injectors functions in a similar fashion and their fluid injection rate is also controllable from the surface.

The FFM calibration is based on the observed production history. If any uncertainty exists in the historical production data, or if the field has not been water flooded for a long enough period of time, the historical dataset might be insufficient to accurately calibrate the model. In such cases, the model parameters and derived predictions become uncertain.

To quantify the level of uncertainty for the model, the system identifies a range of connection efficiency that can fit the historical data. Adjusting the model parameters through a numerical optimization strategy, the system searches for the maximum and minimum connection efficiency that can match the production history within a specified tolerance. The method thus defines a range of uncertainty for the model parameters. The parameters corresponding to the maximum and minimum uncertainties can then be used to forecast performance metrics such as future oil, water or gas production rates. This will yield, for each forecasted metric, a range of uncertainty.

To further refine the uncertainty analysis, the system may use a Monte Carlo sampling method to obtain a full statistical distribution of the possible model parameters and forecast values. First, an a priori probability distribution function of the uncertain model parameters is defined. Then, the algorithm samples the model parameters based on these a priori distributions and compares the corresponding model to historical data. If the model matches within a pre-defined tolerance, the sample is retained, and otherwise it is discarded. The process gets repeated a large number of times (e.g. thousands of times) and the matched models are analyzed. The parameters of the matched models form the posterior probability distribution function and the corresponding forecasted values are then described probabilistically through statistical distributions.

Once the inter-well or well-aquifer connections 333 have been determined by the material flow model 330, an optimization is performed on the rate controls of existing wells. During this optimization, the system searches for an optimal well rate target for each producer 332 and injector 331 in terms of a user-defined objective and constraints.

At least in some embodiments, the formulation of the optimization includes three basic elements: control variables, an objective function, and a set of constraints. The optimization process adjusts the values of the control variables to maximize or minimize the objective value while satisfying the constraints. The control variables used in the system may include the liquid rates of each well. One objective may be to maximize oil production, or minimize water production. Other objectives can involve an economic model and can aim at maximizing the net present value of the field or minimize the operating expenses. Constraints that are often used include field oil production target, well maximum or minimum rates, well maximum or minimum rate changes, maximum voidage replacement ratio for a group of wells, maximum surface liquid capacity, etc.

The objective and constraints to be considered by the optimization engine are translated into functions of the oil, water or gas production and injection rates which are in turn indirect functions of the control variables through the material flow model 330. Given an adjusted configuration of well liquid rates, the material flow model 330 estimates the oil, water and gas production rates which are used to compute the new value of the objective function. The system's optimization engine iterates through various well control configurations and associated estimated objective values while satisfying the constraints. The process continuously improves the solution until reaching an optimum or until another stopping criterion has been reached.

A visualization platform may also be provided by the system. The complex results computed by the system may be reviewed, understood and cross-validated by users such as members of an operational team. The results herein are presented in an interactive interface that contains display tailored to the problem.

In order to analyze a network of connections in a reservoir, an advanced visualization method is described herein that allows a user to quickly grasp the general flow characteristics of the reservoir. In the embodiments here, a visualization method is provided for inter-well and well-aquifer connections that have been computed through a SWM model. To understand the flow characteristics within a group of wells, a display may be provided such as the one presented in FIG. 9. In this display, each inter-well or well-aquifer connection above a certain strength is represented with an arrow between the two connected entities and displayed on a map.

When focusing on a single well, the visualization changes to a display such as that shown in FIG. 10, where all the connected wells or aquifer to a well of interest are displayed with a connection arrow. On each connected well or aquifer, a pie chart may be presented alongside the arrow, where the size of the pie represents the strength (or total liquid rate) of the connection and the proportion represents the efficiency (or proportion of flowing fluids). These visualization systems, along with systems for determining strength, efficiency, and uncertainty in a model, will be described in greater detail below with regard to methods 1200 and 1300 of FIGS. 12 and 13, respectively.

Figure 12:
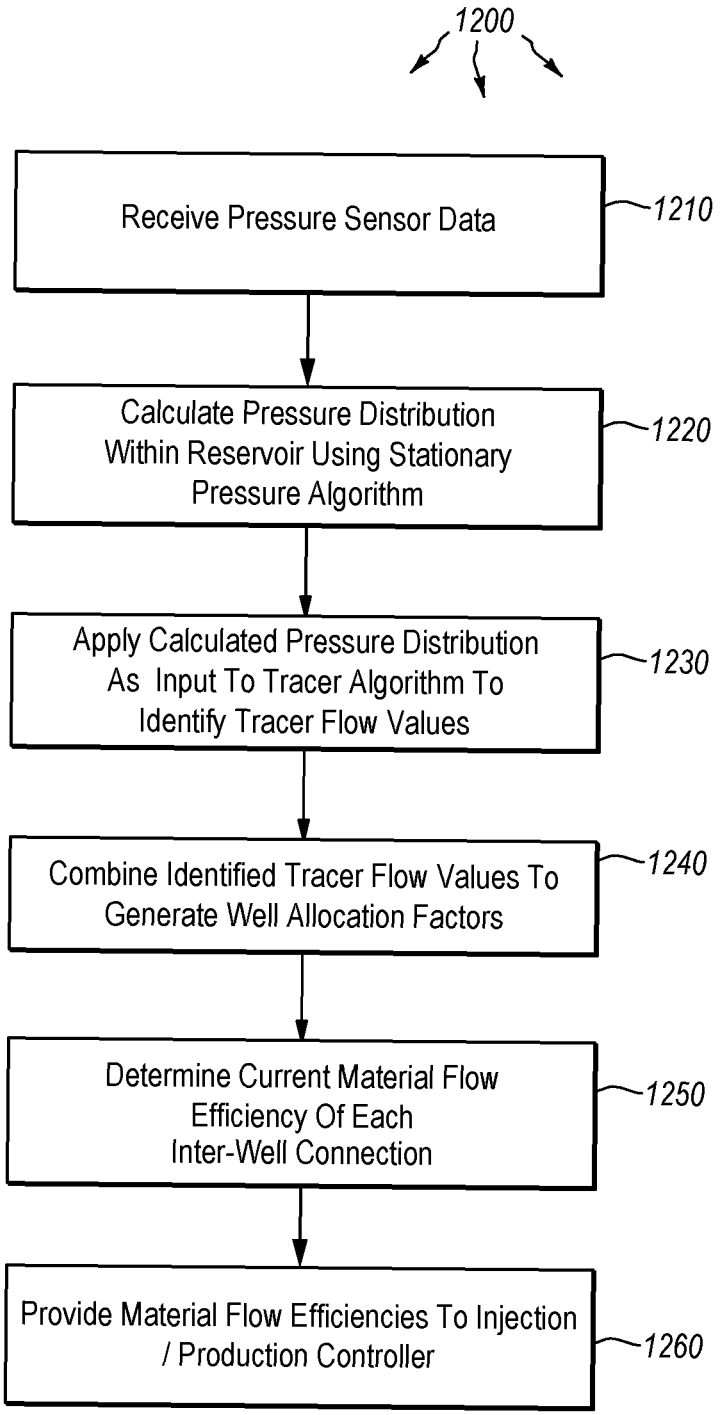
FIG. 12 illustrates a flowchart of an example method for modeling physical material flow relationships between injector wells and producer wells in a reservoir.
Figure 13:
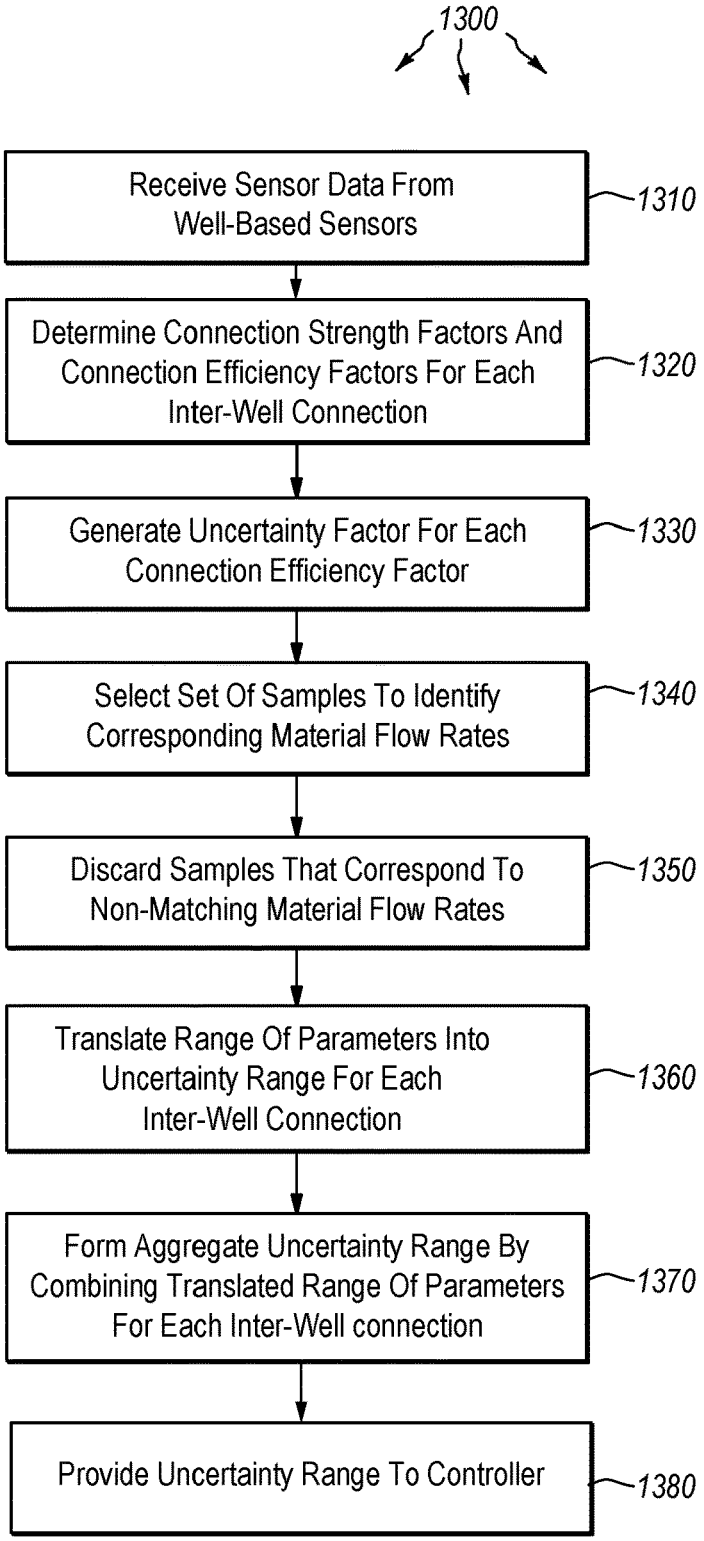
FIG. 13 illustrates a flowchart of an example method for quantifying a level of uncertainty in a connection-based model.

In view of the systems and architectures described above, methodologies that may be implemented in accordance with the disclosed subject matter will be better appreciated with reference to the flow charts of FIGS. 12 and 13. For purposes of simplicity of explanation, the methodologies are shown and described as a series of blocks. However, it should be understood and appreciated that the claimed subject matter is not limited by the order of the blocks, as some blocks may occur in different orders and/or concurrently with other blocks from what is depicted and described herein. Moreover, not all illustrated blocks may be required to implement the methodologies described hereinafter.

FIG. 12 illustrates a flowchart of a method 1200 for modeling and controlling physical material flow relationships between injector wells and producer wells in a reservoir. The method 1200 will now be described with frequent reference to the components and data of environment 300 of FIG. 3, as well as the embodiments shown in FIGS. 4-11.

Method 1200 includes receiving, from one or more hardware-based sensors (104) distributed in one or more locations within the reservoir, where the sensor data indicates material flow rate currently present at each sensor location (1210). The hardware-based pressure sensors may include any type of mechanical, electrical or electromechanical sensors configured to sense material flow rate, pressure, or other measurable item and provide related sensor data. Such readings may be taken at the surface of a reservoir, along an injection well, along a production well, at or near the reservoir, or at other locations. Each sensor may provide sensor data via wired or wireless connections to the computer system 301 of FIG. 3.

Method 1200 next includes calculating pressure distribution within the reservoir using a stationary pressure algorithm to identify variations of pressure at the one or more locations within the reservoir using the received sensor data (1220). For example, the pressure distribution calculator 310 of computer system 301 can use a stationary (i.e. non-time-dependent) pressure algorithm or equation 311 to calculate pressure variations 312 within a reservoir. For instance, as shown in FIG. 4, a reservoir 401 may have many different wells including producer wells 402 and injector wells 403, as well as inactive wells 404 that no longer produce recoverable material. These wells may be distributed over a great distance, and may include many different inter-well connections. Each inter-well connection may be of a different size, shape, strength and efficiency. The efficiency indicates how well material flows through the connection, while the strength indicates the amount of fluid that flows through the connection. Strong connections have more material flow than weak connections, and more efficient connections have a greater flow rate than less efficient connections.

In some cases, the computer system 301 may be configured to identify a mean reservoir pressure for a reservoir. If the reservoir has at least one injector well and at least one producer well, the computer system 301 may determine the mean reservoir pressure according to a material balance model. The identified mean reservoir pressure and the calculated pressure distribution 312 may be combined to generate a pressure measurement representing the pressure within the reservoir. This pressure measurement may then be provided as input to a tracer algorithm.

Method 1200 next includes applying the calculated pressure distribution as an input to a tracer algorithm for at least one injector well and for at least one producer well to identify tracer flow values for materials flowing from a seed point in the injector well to the producer well, where the tracer flow values provide an indication of material flow volume attributable to the seed point (1230). For example, the tracer flow value identifier 313 may use the determined pressure variations 312 as an input to the tracer algorithm or equation 314. The tracer algorithm describes how a tracer (e.g. a dye) flows from a given injection to a given producer. The tracer maps where the dye will end up. As such, the tracer algorithm can show the volume of the reservoir connected hydraulically to the injector well.

Once the connected injection volume is known, a connected production volume (i.e. drainage volume) can be determined. In the tracer algorithm, a tracer concentration factor is a value between 0-1. Using this value and the connected injection and production volumes, a map of the where the drainage volume and injected volumes coexist can be generated. This map represents the connected volume between injector and producer. This is effectively an estimate of the volume of fluid shared by injector and producer. This volume of fluid may be compared to the volume of fluid that is connected to the injector to determine a well location factor.

Using the pressure variations 312 as input, the tracer flow value identifier 313 can identify tracer flow values for materials flowing from the injector well 331 to the producer well 332. The tracer flow values indicate where material is flowing within the reservoir, and specifically between at least one specified injector well and at least one producer well. Once the tracer flow values are identified, they may be used in subsequent calculations, including the generation of well allocation factors 317.

Method 1200 includes combining the identified tracer flow values from the tracer algorithm to generate one or more well allocation factors representing relationships in material flow through inter-well connections between the injector well and the producer well, the well allocation factors providing a material flow strength measurement (1240). The well allocation factor generator 315 may generate well allocation factors 317 using the tracer flow values. These well allocation factors 317 represent relationships in material flow through inter-well connections 333 between the injector well 331 and the producer well 332 (and/or between a well and an aquifer). The well allocation factors may include or may be part of a material flow strength measurement 318 which provides a measure of how much material is flowing through a given inter-well connection 333. This measurement is useful when determining which injectors to use more heavily, as those injectors with stronger connections to producers will produce more material. As such, injection strategies may be optimized using the material flow strength measurement 318 and/or other well allocation factors 317.

Method 1200 also includes determining a current material flow efficiency level of each inter-well connection using a fractional flow model that incorporates as input the determined material flow strength measurement (1250). The fractional flow model specifies the fraction of material flow in the producer well that originated from the injector well and traveled through a specified inter-well connection. The efficiency determining module 321 of computer system 301 may use a fractional flow model 322 to determine the efficiency of the inter-well connection 333. The material flow strength measurement 318 may be provided as input to the fractional flow model 322. Other factors including strength factors 319 and/or connection efficiency factors 320 may be provided to the efficiency determining module 321 to determine a specific efficiency level for a specified inter-well connection 333.

Method 1200 further includes providing the determined current efficiency 325 of the inter-well connections to an injection/production controller 328, which regulates material flow through the injector well and/or the producer well according to the determined current material flow efficiency levels. The injection/production controller 328 may thus receive the calculated current efficiencies of the inter-well connections and use those efficiencies to make decisions regarding how to best control the flow of injection material into the well and/or control the flow of production material out of the well.

Indeed, as noted previously, many thousands or even millions of gallons of injection material are wasted as a result of not knowing how the injector wells are linked to the production wells. As one skilled in the art will appreciate, reservoirs are most often not simply large pools of oil sitting in one spot, unencumbered by other rock formations. Rather, oil and other valuable gases and materials are spread out over many pockets, channels, cracks and passages. Some of these pockets are linked and some are not, and those that are linked may have stronger or weaker inter-well connections. And, of course, most of these pockets of material are far underground and cannot be directly seen.

Thus, a system that provides accurate and current information regarding the efficiencies of flow between injector wells and producer wells can save many resources that would otherwise be wasted. At least some of the embodiments described herein are designed to determine the fraction of production material attributable to a given amount of injection material. When this fraction is known, production systems can avoid sending injection material down injector wells that are not producing commensurate volumes of production material, and can focus on those injector wells that have high inter-well connection efficiencies, and are producing (or are likely to produce) high volumes of production material.

Once the inter-well connection efficiencies have been determined, they can be provided to the injection/production controller 328 which controls the provisioning of injection material into injector wells, and also controls the production of valuable material at the producer wells. The injection/production controller 328 can take various actions upon receiving the efficiency level data including increasing or decreasing the flow of injection material at any specific injection well 207, increase or decrease the amount of drilling (horizontal or vertical) within a given area, increase or decrease the amount of fracking taking place within a given reservoir, increase or decrease the amount of material flow out of the production wells 203, or take other specified actions. Each of these actions may be carried out via mechanical, electrical or electromechanical mechanisms including opening and closing of valves, changing the state of switches or solenoids, altering drill speed or direction, opening or closing pipes, or performing other physical actions that alter the flow of materials through the well.

The reservoir for which the various calculations are performed by the systems and models described herein may be under secondary recovery. As such, injector wells inject material into a space in the reservoir, and producer wells produce or recover valuable material from that space. Secondary recovery is often used when initial methods of recovering material have failed or slowed substantially. Embodiments herein may be implemented to forecast production-injection behavior for a reservoir under secondary recovery for a specified period of time in the future. The behavior may include inter-well connection efficiency, material flow strength, or other behaviors.

In some embodiments, forecasting production-injection behavior for a reservoir under secondary recovery includes the following: accessing an efficiency indication (320) for each inter-well connection 333, estimating the future oil, water or gas rates of the producer well 332 and the injector well 331 based on target liquid flow rates. These target liquid flow rates may be obtained by performing the following: setting a target liquid flow rate for each producer well 332 and injector well 331 for a desired forecast time, updating the strength and efficiencies of inter-well connections using the determined efficiency indication, and estimating one or more new oil, water and gas rates of the producer wells and the injector wells using the material flow strength measurement 318, the determined efficiency indication and the liquid rate target. This estimation may be performed quickly and with comparatively few computer processing resources.

The forecast may be used in a variety of scenarios, including optimizing production-injection strategy for a reservoir. Such optimization may include the following: accessing a determined efficiency indication for each inter-well connection, accessing a set of production/injection constraints including well or well group constraints that are applied to flow rates for oil, water, or gas, identifying an objective function for the optimization, which depends on the liquid, oil, water or gas production or injection rates of the wells or well groups, and generating an optimized set of target liquid flow rates for each producer well and injector well.

The optimized set of target liquid flow rates may be obtained by performing the following: estimating a set of target liquid flow rates for each producer well and injector well in the reservoir, calculating a corresponding forecasted production and injection rate, calculating a corresponding value for the identified objective function, and using an optimization algorithm to update the set of target liquid flow rates for each producer well and injector well until the desired objective has been reached or until a stopping criterion has been reached. The optimization algorithm may be similar to or the same as that described above in connection with FIG. 5, where field data is monitored and input data is collected in 502, a reservoir model is created in 502, model parameters are adjusted to match historical well behavior in 503, operational constraints are defined in 504, an optimization engine is run to define optimal operating conditions in 505, and the recommended operational adjustments are implemented in 506. In this manner, operational procedures may be optimized and controlled based on monitored data.

In some cases, the optimization engine may evaluate different values against the well constraints to determine optimal operational changes for each well as part of the production-injection optimization strategy for the reservoir. When operational changes are identified, the changes may automatically cause an increase in or a decrease in the injection rate for at least one injection well in the reservoir. Thus, for example, if high material flow strength is determined for a given inter-well connection 333 between an injector well 331 and a producer well 332, material injection at the injector well 331 may be increased by the controller 328. Due to the high material flow strength between wells, the increase in material injection will result in a commensurate increase in material production. Similarly, inter-well connections that have weaker material flow strength can have less material applied at the injector to conserve injection material and other resources.

It should be noted that while material flow relationships are often described herein as being between an injector well and a producer well, these material flow relationships may also be modeled between well and aquifers in the reservoir using the same systems and methodologies. As in cases where inter-well connections between an injector and a producer are described, inter-well connections between wells and aquifers may also be analyzed and used when controlling material flow through an injector. Thus, in such cases, material flow may be controlled through the injector well based on any type of inter-well connection. Moreover, the material flow may be controlled according to a determined efficiency measurement of the inter-well connections, in addition to or as an alternative to controlling the material flow based on a flow strength measurement.

Controlling material flow through the injector well 331 based on a determined efficiency level of at least one inter-well connection may include varying the flow of material flow based on an identified efficiency or lack of efficiency in a particular inter-well connection. Thus, in cases where a high level of flow efficiency is determined, an increased amount of flow material may be injected in the injector well. Similarly, in cases where a low level of flow efficiency is identified, a decreased amount of flow material may be injected through the injector well. Uncertainty in these inter-well connections and the measurements thereof will now be addressed with reference to FIG. 13.

FIG. 13 illustrates a flowchart of a method 1300 for quantifying a level of uncertainty in a connection-based model. The method 1300 will now be described with frequent reference to the components and data of environment 300 of FIG. 3, as well as the embodiments shown in FIGS. 4-11.

Method 1300 includes receiving sensor data from one or more hardware sensors disposed in a well (1310), and determining, based on the received sensor data, one or more connection strength factors and one or more connection efficiency factors for each of a plurality of inter-well connections using at least one of a streamline-based estimation, a tracer-based estimation, or a heuristics-based estimation (1320). For example, computer system 301 may identify connection strength factors 319 as well as connection efficiency factors 320 using one of a variety of different techniques including a streamline-based estimation, a tracer-based estimation, or a heuristics-based estimation. The connection strength factors 319 indicate the amount of material flow between wells, and the connection efficiency factors 320 indicate the rate of material flow between wells over a given time period. The computer system 301 may use input data 309 from users, external computer systems 308, or directly from field data monitoring systems. This input data may be used in a streamline-based estimation, a tracer-based estimation, or a heuristics-based estimation to identify the connection strength and efficiency factors.

Method 1300 next includes generating an uncertainty factor for each connection efficiency factor using an a priori probability distribution function, wherein connection parameters for each inter-well connection are described as including certain connection parameter features, such that having deterministic values for each connection parameter is avoided (1330). The computer system 301 or another factor generator such as the well allocation factor generator 315 may generate uncertainty factors 316 for each connection efficiency factor 320. In this process, an a priori probability distribution function 335 may be used. In the material flow model 330, which includes injector well 331 and producer well 332, inter-well connections 333 may include connection parameters 334. These connection parameters may be described as including certain features. An open-ended description of features is implemented, as opposed to using deterministic values for each connection parameter 334. The open-ended description allows for greater flexibility in describing parameters, as opposed to merely selecting certain values. These connection parameters may then be used, along with samples 336 from the a priori probability distribution function 335 to identify material flow rates for producer wells.

Indeed, method 1300 includes selecting a set of samples 336 from the a priori probability distribution function 335 to identify a set of corresponding material flow rates for the producer wells 332 using the described connection parameters (1340). The computer system 301 discards those samples in the set of samples 336 that correspond to material flow rates that do not sufficiently match a historical rate corresponding to the producer wells (1350). In this step, the computer system 301 may look at stored historical rates (e.g. in stored data 327 in database 326) to determine whether the material flow rates sufficiently match historical material flow rates over a certain period of time. If they do not match, they can be discarded, and rates that do match can be used in identifying material flow rates for the producer well 332.

Thus, for remaining (matching) samples and for each inter-well connection 333, from the a priori probability distribution function 335 of the inter-well connection parameters 334, the computer system 301 translates a range of parameters that lead to a specified history-match into an uncertainty range for each inter-well connection (1360). The aggregate uncertainty range generator 323 of computer system 301 may then form an aggregate uncertainty range 324 by combining the translated range of parameters for each inter-well connection, per well or per well group (1370).

The translated range of parameters identifies those inter-well connections that match a given producer well history for at least a certain amount of time. The matching samples from the a priori distribution function 335 are then combined to generate an aggregate uncertainty range 324 which provides a level of uncertainty for the producer well strength and/or efficiency measurements. This level of uncertainty may then be used by the controller 328 to control the flow of injection or production materials. The formed uncertainty range 324 is then provided to a controller (1380). As such, the controller (e.g. 328) controls the flow of injection or production materials in or from the well based on the aggregate uncertainty range.

Again, as noted above, the controller 328 may use the determined uncertainty range 324 to make changes to the production rate of material at a well. The controller 328 can alter the rate of injection material supplied at an injector well, it can alter the rate of production from a production well, or it can stop production altogether and begin production at another well. These actions may be made automatically by the production system according to the determined uncertainty rate 324, or may be presented to a user who makes a decision regarding production using the uncertainty rate.

In some embodiments, the a priori probability distribution function 335 is a Markov-Chain Monte-Carlo type probability distribution. In such a distribution, values may be in the range of 0-1, and may be of a substantially uniform distribution with no a priori bias. The distribution may be sampled and the material flow model 330 may be tested to determine whether it matches historical data. The more it matches historical data, the less uncertainty is present in the model. Conversely, the less the sample data matches historical data, the more uncertainty is present in the model 330.

The aggregate uncertainty range 324 may be implemented to optimize material flow through an inter-well connection that has some level of efficiency. For example, if there is a connection between wells that is weak, and there was a producer well that was producing a lot of material and stealing material flow from the injector, the system may attempt to force more material (e.g. water) through connections that are highly efficient. In this manner, well operations may be controlled and optimized based on which connections are the strongest and most efficient, and which generally have the lowest level of uncertainty associated with them.

Many of the elements described above may be visualized in the visualizations depicted in FIGS. 7-11. In one embodiment, a visualization is provided on a user interface (UI). A computer program product is provided that includes at least one computer-readable hardware storage device that has thereon computer-executable instructions. When these instructions are executed by one or more hardware processors of a computing system (e.g. 301), they cause the computing system to instantiate a user interface for visualizing inter-well connection strength and inter-well connection efficiency. The interface includes one or more elements, including a first element that illustrates an estimation of strength for each inter-well connection.

The first element that illustrates an estimation of strength for each inter-well connection is shown in visualization 701 of FIG. 7. Such an estimation of strength may be generated using sensor data provided by one or more hardware sensors disposed in a well, the sensor data being implemented in a stationary pressure equation that is subject to pressure or rate boundary conditions at the wells and reservoir boundaries. The estimation of strength may alternatively be generated by implementing a tracer algorithm that is subject to tracer concentration boundary conditions at the wells and reservoir boundaries. Still further, the estimation of strength may alternatively be generated by post-processing a tracer solution resulting from the tracer algorithm 314 to determine a level of fluid connectivity between two wells.

The user interface includes a second element that illustrates an estimation of the efficiency of each inter-well connection obtained using an empirical fractional flow model or a physics-based model. The fractional flow model specifies the fraction of material flow in a producer well that originated from an injector well and traveled through a specified inter-well connection. The visualization 801 of FIG. 8 illustrates efficiencies of inter-well connections between producer wells and injector wells.

A third element is also provided in the UI, the third element representing the inter-well connections. Visualization 901 of FIG. 9 shows an embodiment where each connection between wells is represented by a specified visual element (e.g. an arrow) between the wells. In some cases, the strength, efficiency or uncertainty of the connection may be represented by a variation in color, shape, line thickness or line style of the specified visual element (see FIGS. 9-11). Each connection between two wells may be represented by an arrow between the two wells, and each connection between a well and an aquifer may be represented by an arrow that links the well to the aquifer boundary. A fourth element in the UI is a control element that allows material flow through the injector well and/or the producer well to be controlled according to the determined current inter-well connection efficiency. The fourth element may include controls that allow a user to make changes to the amount of material being injected at the injection well, and may also allow a user to make changes to the amount of material being produced at the production well.

The visualization representing inter-well connection strength and the visualization for representing inter-well connection efficiency are implemented to visualize inter-well or well-aquifer connection strength and efficiency in a manner that is easy to understand and quickly see. The UI with these visualizations includes an estimation of the strength of each inter-well (or well-aquifer) connection. These strength estimations may be obtained by solving a stationary pressure equation (e.g. 311), subject to pressure or rate boundary conditions at the well and reservoir boundaries, solving a tracer equation (e.g. 314), subject to tracer concentration boundary conditions at the well and reservoir boundaries, and post-processing the tracer solution to determine fluid connectivity between the two wells (or between a well and a an aquifer boundary). The estimation of efficiency for each inter-well (or well-aquifer) connection may be obtained by an empirical fractional flow model (e.g. 322) or a physics-based model. Once obtained, a graphical representation of the inter-well connections of a specified well may be provided in a visualization.

A specific well may be represented as a focal point 1002 of the visualization (see FIG. 10). Each well connected to the specified well may be represented by a bubble 1003, whose size or color composition is adjusted to represent the strength and efficiency of the connection. The location of the well may be on an aquifer boundary. Each of these connections may be represented by an arrow or other graphical element, whose color, shape, line thickness or line style is adjustable to represent connection strength, efficiency, or uncertainty of the connection. Users may be able to interact with the user interface or any visualizations of the interface. For instance, a user may be able to click on or otherwise select an injector and look each of the producers that are connected to that injector. Each inter-well connection may be longer or shorter, or colored brighter or duller to indicate a stronger or weaker connection. These inter-well connections may change over time as pressure changes. Accordingly, the UI may be continually updated to represent the latest representation of the connections.

Thus, using the systems and models described herein, injection and production flows may be adjusted so that material is moved to the best producers and water (or other less desirable fluids) is moved away from them. This minimizes waste and optimizes production values. Accordingly, methods, systems and computer program products are provided which model physical material flow relationships between injector wells and producer wells in a reservoir. Moreover, methods, systems and computer program products are also provided which quantify a level of uncertainty in a connection-based model. Still further, a user interface may be provided with various visualizations that show, in a clear and understandable manner, the inter-well connection strength and inter-well connection efficiency among specified wells in a reservoir.

The concepts and features described herein may be embodied in other specific forms without departing from their spirit or descriptive characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

We claim:

1. A method, implemented at a computer system that includes at least one processor, for modeling and controlling physical material flow relationships between injector wells and producer wells in a reservoir to improve performance of the reservoir, the method comprising:

receiving, from one or more hardware-based sensors distributed in one or more locations within the reservoir, sensor data indicating a material flow rate currently present at each sensor location;

calculating pressure distribution within the reservoir using a stationary pressure algorithm to identify variations of pressure at the one or more locations within the reservoir using the received sensor data;

applying the calculated pressure distribution as an input to a tracer algorithm for at least one injector well and for at least one producer well to identify tracer flow values for materials flowing from a seed point in the injector well to the producer well, the tracer flow values providing an indication of material flow volume attributable to the seed point;

combining the identified tracer flow values to generate one or more well allocation factors representing relationships in material flow through inter-well connections between the injector well and the producer well, the well allocation factors providing a material flow strength measurement;

determining a current material flow efficiency level of each inter-well connection using a fractional flow model that incorporates as input the determined material flow strength measurement, the fractional flow model specifying the fraction of material flow in the producer well that originated from the injector well and traveled through a specified inter-well connection;

providing the determined current material flow efficiency levels of the inter-well connections to an injection and/or production controller, which regulates material flow through the injector well and/or the producer well according to the determined current material flow efficiency levels; and controlling material flow through the injector well based on the determined current material flow efficiency levels of the inter-well connections to thereby improve performance of the reservoir, wherein if the determined current efficiency is above a determined efficiency measurement, controlling material flow through the injector well comprises increasing an amount of flow material injected through the injector well, and wherein if the determined current efficiency is below the determined efficiency measurement, controlling material flow through the injector well comprises decreasing the amount of flow material injected through the injector well.

2. The method of claim 1, wherein the reservoir is under secondary recovery.

3. The method of claim 2, further comprising forecasting production-injection behavior for the reservoir under secondary recovery for a specified period of time in the future.

4. The method of claim 3, wherein forecasting production-injection behavior for the reservoir under secondary recovery for a specified period of time in the future comprises the following:

accessing the determined efficiency indication for each inter-well connection;

estimating the future oil, water or gas rates of the producer well and the injector well based on target liquid flow rates obtained by:

setting a target liquid flow rate for each producer well and injector well for a desired forecast time;

updating the strength and efficiencies of inter-well connections using the determined efficiency indication; and estimating one or more new oil, water and gas rates of the producer wells and the injector wells using the material flow strength measurement, the determined efficiency indication and the liquid rate target.

5. The method of claim 2, further comprising optimizing production-injection strategy for the reservoir, including performing the following:

accessing the determined efficiency indication for each inter-well connection;

accessing a set of production and/or injection constraints including well or well group constraints that are applied to flow rates for oil, water, or gas;

identifying an objective function for the optimization, which depends on the liquid, oil, water or gas production or injection rates of the wells or well groups; and generating an optimized set of target liquid flow rates for each producer well and injector well obtained by:

estimating a set of target liquid flow rates for each producer well and injector well in the reservoir;

calculating a corresponding forecasted production and injection rate;

calculating a corresponding value for the identified objective function; and using an optimization algorithm to update the set of target liquid flow rates for each producer well and injector well until at least one of the following has occurred: the desired objective has been reached or a stopping criterion has been reached.

6. The method of claim 5, wherein optimizing production-injection strategy for the reservoir includes an optimization engine evaluating different values against the well constraints to determine optimal operational changes for each well.

7. The method of claim 6, wherein the determined optimal operational changes automatically cause an increased or decreased injection rate for at least one well in the reservoir.

8. The method of claim 1, wherein physical material flow relationships are modeled between at least one well and an aquifer in the reservoir.

9. The method of claim 1, further comprising controlling material flow through the injector well based on the determined current efficiency of the inter-well connections.

10. The method of claim 9, wherein controlling material flow through the injector well based on the determined efficiency of the inter-well connections includes varying the flow of material flow based on an identified efficiency or lack of efficiency in the specified inter-well connection.

11. The method of claim 1, further comprising:

identifying a mean reservoir pressure for a reservoir, the reservoir including at least one injector well and at least one producer well, the mean reservoir pressure being determined according to a material balance model; and combining the identified mean reservoir pressure and the calculated pressure distribution to generate a pressure measurement representing the pressure within the reservoir.

12. A method, implemented at a computer system that includes at least one processor, for quantifying a level of uncertainty in a connection-based model to improve performance of a reservoir, the method comprising:

determining, based on received sensor data, one or more connection strength factors and one or more connection efficiency factors for each of a plurality of inter-well connections using at least one of a streamline-based estimation, a tracer-based estimation, or a heuristics-based estimation;

generating an uncertainty factor for each connection efficiency factor using an a priori probability distribution function, wherein connection parameters for each inter-well connection are described as including certain connection parameter features, such that having deterministic values for each connection parameter is avoided;

selecting a set of samples from the a priori probability distribution function to identify a set of corresponding material flow rates for the producer wells using the described connection parameters;

discarding those samples in the set of samples that correspond to material flow rates that do not sufficiently match a historical rate corresponding to the producer wells;

for remaining samples for each inter-well connection, from the a posteriori probability distribution function of the inter-well connection parameters, translating a range of parameters that lead to a specified history-match into an uncertainty range for each inter-well connection;

forming an aggregate uncertainty range by combining the translated range of parameters for each inter-well connection, per well or per well group; and providing the formed aggregate uncertainty range to a controller and based on the aggregate uncertainty range, altering, via the controller, a flow of injection or production materials in or from a well associated with the reservoir to thereby improve performance of the reservoir, wherein if the aggregate uncertainty range is below a threshold, altering the flow of injection or production materials in or from the well comprises increasing the flow of injection material in the well and/or increasing the flow of production material from the well, and wherein if the aggregate uncertainty range is above a threshold, altering the flow of injection or production materials in or from the well comprises decreasing the flow of injection material in the well and/or decreasing the flow of production material from the well.

13. The method of claim 12, further comprising controlling the material flow within the producer wells in accordance with the formed aggregate uncertainty range.

14. The method of claim 12, wherein the a priori probability distribution function comprises a Markov-Chain Monte-Carlo type probability distribution.

15. The method of claim 12, wherein the aggregate uncertainty range is implemented to optimize material flow through an inter-well connection that has at least a specified level of efficiency.

16. A method, implemented at a computer system that includes at least one processor, for modeling and controlling physical material flow relationships between injector wells and producer wells in a reservoir under secondary recovery to improve performance of the reservoir, the method comprising:

receiving, from one or more sensors associated with the reservoir, sensor data indicating a material flow rate at one or more locations of the reservoir;

calculating a pressure distribution within the reservoir to identify variations of pressure between the one or more locations within the reservoir using the received sensor data;

applying the pressure distribution to identify tracer flow values for materials flowing from a seed point in an injector well to a producer well, the tracer flow values providing an indication of material flow volume attributable to the seed point;

combining the tracer flow values to generate one or more well allocation factors representing relationships in material flow through inter-well connections between the injector well and the producer well, the one or more well allocation factors providing a material flow strength measurement;

determining a current material flow efficiency level of each inter-well connection based on at least the material flow strength measurement, the current material flow efficiency level specifying a fraction or volume of material flow in the producer well that originated from the injector well and traveled through a specified inter-well connection;

optimizing a production-injection strategy for the reservoir based on at least the current material flow efficiency level of each inter-well connection, wherein optimizing the production-injection strategy comprises:

accessing an efficiency indication for each inter-well connection;

accessing a set of production and/or injection constraints including well or well group constraints that are applied to flow rates for oil, water, or gas;

identifying an objective function for the optimization, which depends on the oil, water, or gas production or injection rates of the wells or well groups; and evaluating different values against the well constraints to determine optimal operational changes for each well; and providing the determined optimal operational changes to an injection and/or production controller to cause an increased or decreased injection rate for at least one well in the reservoir to modify liquid production rate from the reservoir, thereby improving reservoir performance.

17. The method of claim 16, wherein optimizing the production-injection strategy for the reservoir further comprises generating an optimized set of target liquid flow rates for each producer well and injector well.

18. The method of claim 17, wherein generating the optimized set of target liquid flow rates for each producer well and injector well, comprises:

estimating a set of target liquid flow rates for each producer well and injector well in the reservoir;

calculating a corresponding forecasted production and injection rate;

calculating a corresponding value for the identified objective function; and using an optimization algorithm to update the set of target liquid flow rates for each producer well and injector well until at least one of the following has occurred: the desired objective has been reached or a stopping criterion has been reached.

* * * * *